US007520583B2

(12) United States Patent
Arazaki et al.

(10) Patent No.: US 7,520,583 B2
(45) Date of Patent: Apr. 21, 2009

(54) PRINTING DEVICE, PRINTING PROGRAM, PRINTING METHOD, IMAGE PROCESSING DEVICE, IMAGE PROCESSING PROGRAM, IMAGE PROCESSING METHOD, AND RECORDING MEDIUM IN WHICH THE PROGRAM IS STORED

(75) Inventors: Shinichi Arazaki, Shimosuwa-machi (JP); Naoki Kayahara, Chino (JP); Toru Takahashi, Matsumoto (JP); Hiroaki Sakai, Chino (JP)

(73) Assignee: Seiko Epson Corporation (JP)

( * ) Notice: Subject to any disclaimer, the term of this patent is extended or adjusted under 35 U.S.C. 154(b) by 317 days.

(21) Appl. No.: 11/389,938

(22) Filed: Mar. 27, 2006

(65) Prior Publication Data

US 2006/0244774 A1 Nov. 2, 2006

(30) Foreign Application Priority Data

Mar. 29, 2005 (JP) ..... 2005-094763
Dec. 7, 2005 (JP) ..... 2005-353530

(51) Int. Cl.
*B41J 2/205* (2006.01)

(52) U.S. Cl. ..... 347/15; 347/19

(58) Field of Classification Search ..... 347/42; 358/1.9

See application file for complete search history.

(56) References Cited

U.S. PATENT DOCUMENTS 6,283,571 B1 9/2001 Zhou et al.
6,293,643 B1 9/2001 Shimada et al.
6,328,404 B1 12/2001 Fujimori
6,641,253 B2 * 11/2003 Silverbrook et al. ..... 347/42
6,908,176 B2 6/2005 Koitabashi
2003/0085939 A1 5/2003 Koitabashi

FOREIGN PATENT DOCUMENTS

| | | |
|---|---|---|
| JP | 01-235655 | 9/1989 |
| JP | 05-030361 | 2/1993 |
| JP | 05-092559 | 4/1993 |
| JP | 11-151821 | 8/1999 |
| JP | 11-254662 | 9/1999 |
| JP | 2000-79710 | 3/2000 |
| JP | 2000-190470 | 7/2000 |
| JP | 2000-225716 | 8/2000 |
| JP | 2002-019101 | 1/2002 |
| JP | 2003-063043 | 3/2003 |
| JP | 2003-136702 | 5/2003 |
| JP | 2004-042456 | 2/2004 |
| JP | 2004042456 A * | 2/2004 |

* cited by examiner

*Primary Examiner*—Luu Matthew
*Assistant Examiner*—Justin Seo
(74) *Attorney, Agent, or Firm*—Harness, Dickey & Pierce, P.L.C.

(57) ABSTRACT

A printing device includes: a print head having nozzles for printing different size dots; an acquirer acquiring discharge deviation characteristic information of the nozzles; an acquirer acquiring M-level image data (M≧3); an identifier identifying pixels relating to discharge deviation based on the discharge deviation characteristic information from the discharge deviation characteristic information acquirer out of respective pixels in the M-level image data; an adjuster adjusting pixel values of the pixels relating to the discharge deviation from the deviated pixel identifier; a generator generating N-level data (M>N≧2) for image data in which the pixel value is adjusted; a generator generating the print data to which the dots having sizes corresponding to the respective pixels are allocated based on the N-level data, and a printer using the print head to print based on the print data.

7 Claims, 18 Drawing Sheets

300A

| DOT SIZE (DOT DIAMETER) | GRADATION VALUE | DENSITY (BRIGHTNESS) | MULTI-LEVEL RANGE | THRESHOLD |
|---|---|---|---|---|
| NO DOT | 1 | 0(255) | 211 ~ 255 | |
| SMALL | 2 | 85(170) | 127 ~ 210 | ← 210 (FIRST THRESHOLD) |
| MEDIUM | 3 | 170(85) | 43 ~ 126 | ← 126 (SECOND THRESHOLD) |
| LARGE | 4 | 255(0) | 0 ~ 42 | ← 42 (THIRD THRESHOLD) |

300B

| NOZZLE Nos. | DISCHARGE DEVIATION PHENOMENON (DISCHARGE ACCURACY) [μm] |
|---|---|
| 0 | 0 |
| 1 | +1 |
| 2 | −2 |
| 3 | · |
| · | · |
| · | · |
| · | · |
| 179 | −3 |
| 180 | 0 |

FIG. 7

FIG.12A
FIG.12B
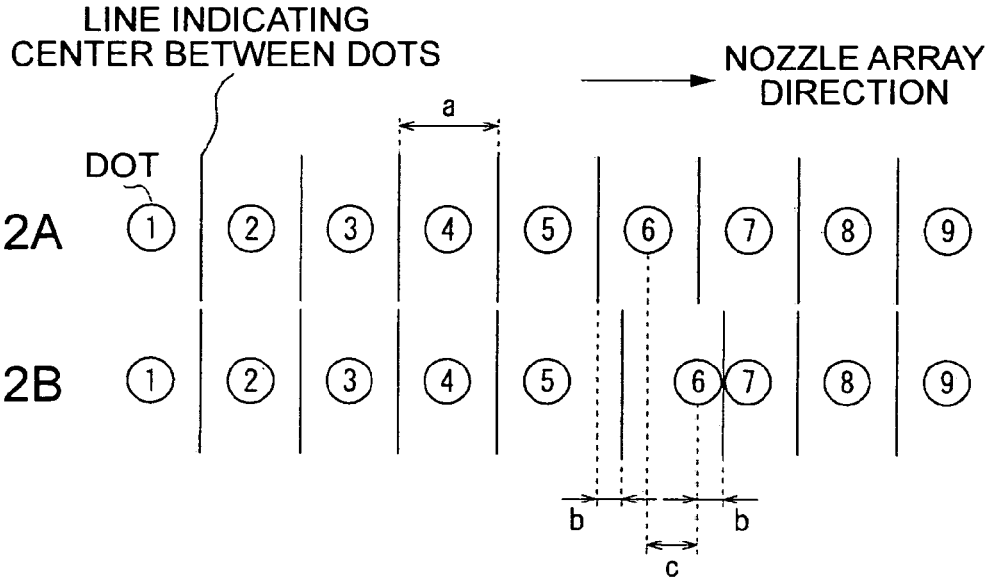
FIG.13A
FIG.13B
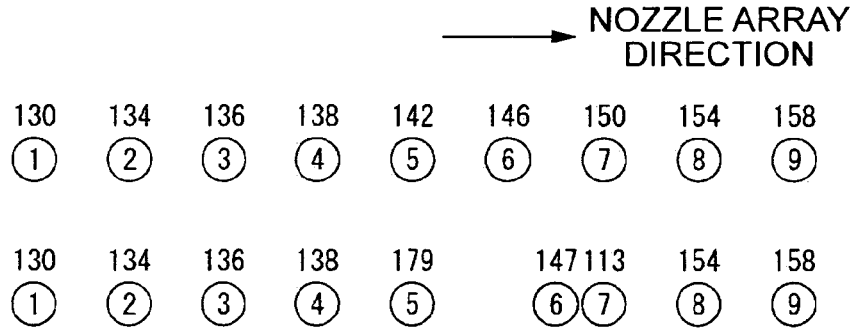
FIG.14A
| 1 | 2 | 3 | 4 | 5 | 6 | 7 | 8 | 9 |
|---|---|---|---|---|---|---|---|---|
| 130 | 134 | 136 | 138 | 142 | 146 | 150 | 154 | 158 |
FIG.14B
| | | | | | | | | |
|---|---|---|---|---|---|---|---|---|
| 130 | 134 | 136 | 138 | 179 | 147 | 113 | 154 | 158 |

PRINTING DEVICE, PRINTING PROGRAM, PRINTING METHOD, IMAGE PROCESSING DEVICE, IMAGE PROCESSING PROGRAM, IMAGE PROCESSING METHOD, AND RECORDING MEDIUM IN WHICH THE PROGRAM IS STORED

RELATED APPLICATIONS

This application claims priority to Japanese Patent Application Nos. 2005-094763 filed Mar. 29, 2005 and 2005-353530 filed Dec. 7, 2005 which are hereby expressly incorporated by reference herein in their entirety.

BACKGROUND

1. Technical Field

The present invention relates to a printing device such as a facsimile device, a copying machine, or a printer for office automation equipment and, more specifically, to a printing device, a printing program, a printing method, an image processing-device, an image processing program, an image processing method, and a recording medium in which the program is stored suitable for performing a printing process of a so-called inkjet system, in which predetermined characters or images are drawn on a printer sheet (recording material) by discharging fine particles of liquid ink in a one or more colors.

2. Related Art

A printer, and more specifically, a printer in which such an inkjet system is employed (hereinafter, referred to as "inkjet printer") will be described below.

Inkjet printers are widely used not only in offices, but also among general users in tandem with the popularity of personal computers and digital cameras since they are generally cost effective and can easily provide a high-quality color printing.

An inkjet printer is adapted to create a desired printed material by moving a movable member including an ink cartridge and a print head integral therewith, which is called a "carriage" or the like, over a printing medium (paper) reciprocally in a direction vertical to a paper-feeding direction while discharging (injecting) particles of liquid ink from a nozzle of the print head in dots, thereby drawing predetermined characters or images on the printer sheet. When four of such ink cartridges for four color printing including black (yellow, magenta, cyan), and the print heads for the respective colors are provided on the carriage, not only monochrome printing, but also full color printing can be easily achieved by combining these colors (in addition, combinations of six, seven, and eight colors with light cyan or light magenta added thereto have also come into practical use).

In the inkjet printer of the type in which printing is executed by moving the print head on the carriage reciprocally in the direction vertical to the paper-feeding direction (a widthwise direction of the printer sheet), it is necessary to cause the print head to reciprocate from several tens of times to more than one hundred times in order to achieve a good-looking printing on one page. Therefore, it has a drawback such that a significantly long printing time is required in comparison with a printing device of other systems, such as a laser printer in which an electrophotographic technology such as a copying machine is employed.

In contrast, in the inkjet printer of a type in which an elongated print head having the same (or larger) length as the width of the printer sheet is arranged so that the carriage is not used, and hence it is not necessary to move the print head in a widthwise direction of the printer sheet. Therefore, a so-called single-scan (single-pass) printing is achieved, and hence high-speed printing as with the laser printer is enabled. In addition, since the carriage to mount the print head and a drive system for moving the same are not necessary, reduction of the size and weight of an enclosure of the printer is possible. Furthermore, noise reduction is significantly improved. The inkjet printer of the former type is generally called a "multi-pass type printer" and the one of the latter type is generally called a "line-head type printer".

The print head which is essential in the inkjet printer includes minute nozzles on the order of 10-70 μm in diameter at predetermined intervals arranged in series or in a plurality of rows in the printing direction. Therefore, for example, there may be a case in which directions of ink discharge from some of the nozzles are angled or the positions of the nozzles are arranged at positions deviated from ideal positions due to manufacturing error and, consequently, landing positions of dots formed on the printing medium by these nozzles are deviated from ideal positions, which is called a "discharge deviation phenomenon". Due to such non-uniform characteristics of the nozzles, those which vary widely from others may discharge much more or much less ink in comparison with an ideal amount.

Consequently, there is a case in which defective printing results, which is called a "banding phenomenon", at a part printed by the defective nozzles and hence the printing quality is significantly lowered. In other words, when the discharge deviation phenomenon occurs, distances between dots discharged from adjacent nozzles become uneven. Parts in which the distances between the adjacent dots are longer than the normal distance, "white bands" (when the printer sheet is white) are generated, and parts in which the distances of the adjacent dots are shorter than the normal distance, "dark bands" are generated. In a case in which the value of the amount of ink is deviated from the ideal value, the dark bands are generated at positions of the nozzles which discharge the larger amount of ink and the white bands are generated at positions of the nozzles which discharge the less amount of ink.

In particular, such a banding phenomenon tends to occur in the "line-head type printer" in which the print head or the printing medium is fixed (single-pass printing) in comparison with the above-described "multi-pass type printer" (The multi-pass type printer has a technique that reduces the banding phenomenon to an invisible level using a technique of reciprocating the print head many times).

Therefore, in order to prevent a sort of defective printing due to the "banding phenomenon", study and development in a way pertaining to hardware such as improvement in technology of manufacturing the print head or improvement of design have been carried out. However, it is difficult to provide a print head in which the occurrence of the "banding phenomenon" is completely eliminated because of the manufacturing cost and technological limitations.

Therefore, in the status quo, in addition to the improvement in a way pertaining to hardware as described above, a technology to reduce the "banding phenomenon" in a way pertaining to software, such as printing control as shown below is employed in parallel.

In order to cope with fluctuations of the nozzles or non-discharging of ink, for example, in JP-A-2002-19101 and JP-A-2003-136702, a shading correction technique is used for portions with less density to cope with the fluctuations of the heads, and other colors are used for portions of high density to reduce the banding or fluctuations to an invisible level.

In JP-A-2003-63043, in a case of solid color images, a method of increasing amounts of discharge from adjacent nozzles corresponding to proximal pixels of a non-discharge nozzle to form a solid color image with all the nozzles in cooperation is employed.

In JP-A-5-30361, an attempt is made to avoid the banding phenomenon by feeding back the amount of variations of the respective nozzles to an error diffuser to accommodate variations in the amount of ink discharge among the nozzles.

However, in the method of alleviating the banding phenomenon or fluctuations by using other colors as in JP-A-2002-19101 or JP-A-2003-136702, a color hue of parts applied with such processing may vary, and hence it is not suitable for printing images such as a color photo image in which high definition and high quality are required.

When the method of allocating information of non-discharging nozzle to left and right nozzles for the portion of high density to avoid the "white banding phenomenon" is applied to the discharge deviation phenomenon described above, the white bands can be reduced. However, the banding disadvantageously remains in the part with high density.

On the other hand, the method disclosed in JP-A-2003-63043 is effective when printed material is a solid color image. However, this method cannot be applied when it is of intermediate gradations. In a case of a thin line, a method of substituting for the missing color by other colors can be employed without problem as long as it is a very small amount. However, in a case of an image in which other colors appear continuously, there remains a problem that the color hue of the image is partly varied as in the former case.

The method disclosed in JP-A-5-30361 can avoid the banding phenomenon caused by the amount of ink discharge from the nozzles. However, as regards the problem of the banding phenomenon caused by positional displacement of dot formation, adequate feedback is difficult.

SUMMARY

An advantage of some aspect of the invention is, in particular, to provide a novel printing device, a printing program, a printing method, an image processing device, an image processing program, an image processing method and a recording medium in which the program is stored that can eliminate a banding phenomenon due to the discharge deviation phenomenon or reduce the same to an almost invisible level.

Mode 1

A printing device according to Mode 1 includes: a print head having a plurality of nozzles which can print dots in different sizes; discharge deviation characteristic information acquirer for acquiring discharge deviation characteristic information of the nozzles in the print head; image data acquirer for acquiring M-level image data ($M \geqq 3$); deviated pixel identifier for identifying pixels relating to a discharge deviation phenomenon based on the discharge deviation characteristic information acquired by the discharge deviation characteristic information acquirer out of the respective pixels in the M-level image data ($M \geqq 3$) acquired by the image data acquirer; pixel value adjuster for adjusting pixel values of the pixels relating to the discharge deviation phenomenon identified by the deviated pixel identifier; N-level data generator for generating N-level data ($M > N \geqq 2$) for image data in which the pixel value is adjusted by the pixel value adjuster; print data generator for generating print data to which the dots having sizes corresponding to the respective pixels are allocated based on the N-level data generated by the N-level data generator, and printer for executing printing based on the print data generated by the print data generator using the print head.

Accordingly, the pixel values of the pixels relating to the banding phenomenon vary and hence the sizes of the dots corresponding to these pixels are changed from the dot sizes of a case in which the banding phenomenon is not occurred. Therefore, "white bands" or "dark bands" due to the banding phenomenon caused by a so-called discharge deviation phenomenon can be eliminated effectively or reduced to an almost invisible level.

The term "discharge deviation phenomenon" represents a phenomenon, being different from a phenomenon that some nozzles simply fail to discharge ink as described above, in which ink is discharged but directions of ink discharge from some of the nozzles are inclined or the like, whereby the dots are formed at positions displaced from target positions (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary) Therefore, the discharge deviation characteristic information can be determined irrespective of printing of dots in different sizes.

The term "banding phenomenon" in this specification means a phenomenon in which "white bands (when the printer sheet is white)" or "dark bands" are generated along a paper-feeding direction (printing direction) because the distances between adjacent dots become uneven due to the "discharge deviation phenomenon" as described above. (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The term "white bands" represents a part (area) where a phenomenon in which distances between the adjacent dots are increased with respect to a predetermined distance due to the above-described "discharge deviation phenomenon" occurs consecutively, whereby a base color of printing medium comes into prominence as bands. The term "dark bands" represents a part (area) where a phenomenon in which distances between adjacent dots are reduced with respect to the predetermined distance due to the "discharge deviation phenomenon" occurs consecutively, whereby the base color of the printing medium is hidden, the corresponding part appears to be dark due to the reduction of the distance between the dots, or some of dots formed at displaced positions are overlapped with the normal dots whereby the overlapped portions come into prominent as dark bands (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

Describing the "white bands"/"dark bands" in detail, when the discharge deviation occurs in comparison with the positions printed at normal inter-dot distances, the inter-dot distances of a part of the image printed by the corresponding nozzles become consecutively closer or wider. Therefore, when the inter-dot distances become consecutively closer, inter-dot density is increased, which means that the area gradation becomes darker and hence a darker image is printed. On the other hand, when the inter-dot distances become wider, the inter-dot density is reduced, which means the area gradation becomes paler and hence a paler image is printed. The dark/pale images may occur consecutively in the printing direction at positions where the nozzle in question is in charge, and hence it appears as bands.

The term "M-level (M≧3)" means a so-called multi-level pixel value relating to brightness or density, which is represented as, for example, 8 bits, 256 gradations, and the term "N-value (M>N≧2)" means a process of categorizing the pixel vales of the M-level (multi-level) data into N-sorts based on a certain threshold. When generating the N-level data, a process of conversion into N-level may be performed to generate the N-level data, or alternatively, any methods may be applied as long as the N-leveled N-level data is generated as a consequence. The term "dot size" is a concept including "no-dot" in addition to the size (area) of the dot (this is also applied to a mode relating to a "printing device", a mode relating to a "printing program", a mode relating to a-"printing method", a mode relating to an "image processing device", a mode relating to an "image processing program", a mode relating to an "image processing method", and a mode relating to a "recording medium with the program stored therein", and a description in the section of summary).

The term "pixel value" generally includes "brightness value" and "density value". However, in this and following mode, it mainly represents the "density value" (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The expression "to identify the pixels relating to the discharge deviation phenomenon" means to compare the amount of deviated discharge with a predetermined threshold based on the discharge deviation characteristic information and grade the size (for example, large, medium, small discharge deviation", and processing parameter is changed according to the grade (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The expression "to adjust the pixel value" means to perform a processing to enlarge the dot size for a portion where the inter-dot distance is wide, and to reduce the dot size for a portion where the inter-dot distance is narrow, thereby generating a large dot on purpose. Alternatively, it means to perform compensation of the density of the data according to the discharge deviation characteristic information before being converted into the N-level (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The term "dot" has an area formed by ink discharged from one or more nozzles landed on the printing medium as a matter of course, and a plurality of dots exist in terms of the size. However, the dots formed by discharged ink are not necessarily formed into a complete round. For example, when the dot is formed into a shape other than the complete round such as an oval shape, an average diameter may be employed as its dot diameter. Alternatively, a complete round dot having the same surface area as that of a dot formed by discharging a certain amount of ink is assumed and defined as the dot. The surface area of the dot is not zero and may be treated as the one having a certain size ("dot diameter" means the diameter of the dot). The method of forming dots having different density includes a method of forming dots having the same size and different in density, a method of forming dots having the same density and different in size, and a method of forming dots having the same density and different in amount of ink discharge and differentiating the density by overlapped injection. When part of an ink drop from one nozzle is separated and landed, it is also treated as a dot. However, when two or more dots formed from two nozzles or formed from one nozzle in temporary sequence are combined, they are considered that two dots are formed (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The term "printer" represents a command for causing the "print head" to execute printing operation based on the print data generated by the print data generator in a CPU in a computer integrated in the "printing device".

Mode 2

In the printing device according to Mode 1, preferably, the deviated pixel identifier identifies a pixel corresponding to a nozzle having the discharge deviation phenomenon, and pixels corresponding to nozzles proximate the nozzle having the discharge deviation phenomenon out of the respective nozzles of the print head, and the pixel value adjuster increases the pixel value of the pixel adjacent to the pixel corresponding to the nozzle having the discharge deviation phenomenon and being at a larger distance therefrom out of the pixels identified by the deviated pixel identifier.

Accordingly, the dot size of the pixel adjacent to the pixel corresponding to the nozzle having the discharge deviation phenomenon and being at a larger distance therefrom is increased, and a reduced portion in terms of the area gradation resulted as the white bands can be compensated. Therefore, so called "white bands", which occur between the dot in question and the dot of the pixel corresponding to the nozzle having the discharge deviation phenomenon can be effectively eliminated or reduced to an almost invisible level.

The expression "the pixel being at a larger distance" means that the pixel being at a larger distance from the dot corresponding to the nozzle having the discharge deviation phenomenon out of a pair of dots being at a shorter distance therefrom and at a larger distance therefrom in comparison with an ideal inter-dot distance (distance in the case of normal printing). The pixel being at a larger distance also includes the one exceeding a pixel value of 255, in addition to the pixel valued from 0 to 255.

Mode 3

In the printing device according to Mode 1, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster decreases the pixel value of the pixel adjacent to the pixel corresponding to the nozzle having the discharge deviation phenomenon and being at a smaller distance therefrom out of the pixels identified by the deviated pixel identifier.

Accordingly, the dot size of the pixel adjacent to the pixel corresponding to the nozzle having the discharge deviation phenomenon and being at a smaller distance therefrom is decreased, and a decreased portion in terms of the area gradation resulted as the black bands can be compensated. Therefore, so called "dark bands", which occur between the dot in question and the dot of the pixel corresponding to the nozzle having the discharge deviation phenomenon can be effectively eliminated or reduced to an almost invisible level.

The expression "the pixel being at a smaller distance" means that the pixel being at a smaller distance from the dot corresponding to the nozzle having the discharge deviation phenomenon out of a pair of dots being at a shorter distance therefrom and at a larger distance therefrom in comparison with an ideal inter-dot distance (distance in the case of normal printing). The pixel being at a shorter distance also includes a pixel value of 0 or smaller.

Mode 4

In the printing device according to Mode 1, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster increases the pixel value of the pixel adjacent to the pixel corresponding to the nozzle having the discharge deviation phenomenon and being at a larger distance therefrom and decreases the pixel value of the pixel adjacent to the pixel corresponding to the nozzle having the discharge deviation phenomenon and being at a shorter distance therefrom out of the pixels identified by the deviated pixel identifier.

Accordingly, the dot size of the pixel adjacent to the pixel corresponding to the nozzle having the discharge deviation phenomenon and being at a larger distance therefrom is increased, so called "white bands", which occur between the dot in question and the dot of the pixel corresponding to the nozzle having the discharge deviation phenomenon can be effectively-eliminated or reduced to an almost invisible level. Simultaneously, the dot size of the pixel adjacent to the pixel corresponding to the nozzle having the discharge deviation phenomenon and being at a smaller distance therefrom is decreased, so called "dark bands", which occur between the dot in question and the dot of the pixel corresponding to the nozzle having the discharge deviation phenomenon can be effectively eliminated or reduced to an almost invisible level.

Mode 5

In the printing device according to Mode 4, preferably, the pixel value adjuster adjusts the pixel value of the pixel whose pixel value is to be adjusted to eliminate a difference between apparent density of adjacent dots at a larger distance according to a visual sensation and apparent density of adjacent dots at a smaller distance according to the visual sensation.

Accordingly, adjustment of the pixel value corresponding to the visual sensation of a viewer is achieved, and hence the banding phenomenon can be alleviated further effectively.

Mode 6

In the printing device according to Mode 5, preferably, the pixel value adjuster sets a space having a density which increases with decrease in distance from the dot and adjusts the pixel value of the pixel to minimize a difference between a maximum density value and a minimum density value in the space when adjusting the pixel value of the pixel being at a larger distance from the adjacent pixel to be larger and the pixel value of the pixel being at a smaller distance from the adjacent pixel to be smaller.

Accordingly, utilizing a property such that visual passing sensitivity of high frequency components is lowered (seen out-of-focus), the density variation of the actual dots is set taking the out-of-focus into consideration, so that the density difference is minimized in the area where the white bands or the back bands are generated, whereby the dot arrangement in which the visual white bands and black bands are minimized is achieved.

Mode 7

In the printing device according to any one of Mode 1 to Mode 6, preferably, the printing device includes amount of displacement detector for detecting an amount of positional displacement at which the dot of the pixel corresponding to the nozzle having the discharge deviation phenomenon is actually printed, and the pixel value adjuster calculates the amount of adjustment of the pixel value of the pixel to be adjusted based on the amount of positional displacement of the dot of the pixel corresponding to the nozzle having the discharge deviation phenomenon detected by the amount of displacement detector.

Accordingly, the amount of positional displacement of the dot corresponding to the pixel formed as a result of the discharge deviation phenomenon can be obtained accurately, and hence an accurate pixel value adjustment is achieved.

The amount of displacement detector is activated only at an initial setting (including at a time of shipping), and the pixel value adjuster is activated for each image printing.

The amount of displacement means the amount of positional displacement of actually printed position from an ideal print position.

Mode 8

In the printing device according to Mode 7, preferably, the amount of displacement detector detects the amount of positional displacement of the dot of the pixel corresponding to the nozzle having the discharge deviation phenomenon based on a density distribution of a dot pattern printed using the print head, and calculates the inter-dot distance.

Accordingly, the amount of displacement can be obtained accurately even when the read density distribution of the dot pattern printed using the print head is ambiguous. Since reading accuracy (resolution) of a reading device such as a scanner which reads the dot pattern can be reduced significantly, a reading device of low cost can be used, and hence a cost required for calculating the amount of displacement can be reduced significantly.

If a reading device of higher resolution than the printed dots can estimate peaks and troughs of density from variations in density distribution of the reading device, determine the apexes of the peaks or the troughs as centers of the dots, and detect the center positions of the dots, displacement from the ideal position can also be detected.

Mode 9

In the printing device according to any one of Mode 1 to Mode 8, preferably, the N-level data generator uses an error diffusion method or a dither method when converting the image data in which the pixel value is adjusted by the pixel value adjuster into N-level image data.

When performing conversion into N-level data, by employing the error diffusion method, which is one of known half-tone processing methods, an error generated when converting into the N-level data is allocated to the peripheral pixels according to a predetermined error diffusion matrix and the influence thereof is considered in the following process, whereby the error is minimized as a whole. Therefore, a high-definition printed material in which intermediate gradations are faithfully expressed can reliably be obtained.

By employing the dither method, which is one of the known half-tone processing methods as in the case of the error diffusion method, adequate conversion into the N-level data is ensured, and hence the high-definition printed material in which the intermediate gradations are faithfully expressed can reliably be obtained.

The expression "error dispersion processing" in the invention is the same as the one which is normally used in the field of image processing, and is a processing to allocate the error generated by binarizing process of a certain pixel to the peripheral pixels according to the predetermined error diffusion matrix, and the influence thereof is considered in the following process, whereby the error is minimized as a whole. In other words, it is a method of adjustment in which, when performing binarizing (N=2), the pixels are classified into black (with dots) when the density value of the pixel is larger than an intermediate value which is a half of the number of gradations of the image, and white (no-dot) when it is smaller, then, the error between the density value before the classification and the density value after the classification is diffused to the peripheral pixels at an adequate percentages (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

On the other hand, the "dither method" is also the same as the one used normally in the field of the image processing, and is a processing method in which the density values of the respective pixels in the light and shade images are compared with numeral values in a table prepared in advance, called "dither matrix", which corresponds to the respective pixels, and when performing binarizing (N=2), the pixels are classified into "with dots" and "no dots" by determining the pixel to be black (with dots) when they are larger and to be white (no dots) when they are smaller.

Mode 10

In the printing device according to any one of Mode 1 to Mode 9, preferably, the print head has a length corresponding to a width of the medium so that printing can be achieved by a single scan without the print head being moved in a widthwise direction of the medium.

Accordingly, the "white bands" or the "dark bands" due to the banding phenomenon which occurs specifically when the print head has the length corresponding to the width of the medium and hence can print with a single scan without being moved in the direction of the width of the medium can be eliminated or reduced to an almost invisible level. The print head of this type includes a line-head type print head.

Mode 11

In the printing device according to any one of Mode 1 to Mode 9, preferably, the print head has a length shorter than the width of the medium and reciprocates in a widthwise direction of the medium.

The banding phenomenon described above is obvious in the case of the print head having the length corresponding to the width of the medium and being able to print with a single scan without moving in the direction of the width of the medium. However, it also occurs in the case of the print head which has the length shorter than the width of the medium and reciprocates in a widthwise direction of the medium. The print head also includes a multi-pass type print head.

Therefore, by applying any one of Mode 1 to Mode 9 to the multi-pass type print head, the "white bands" due to the banding phenomenon generated by the multi-pass type print head can reliably be eliminated or reduced to an almost invisible level.

In the case of the multi-pass type print head, the banding phenomenon as described above can be avoided by, for example, repeating scanning of the print head. However, by applying the technique according to Mode 1 to Mode 9, it is not necessary to cause the print head to scan the same position many times, and hence a printing process at higher speed is realized.

Mode 12

A printing program according to Mode 12 causes a computer to function as discharge deviation characteristic information acquirer for acquiring discharge deviation characteristic information of the nozzles in a print head having a plurality of the nozzles which can print dots in different sizes; image data acquirer for acquiring M-level image data ($M \geqq 3$); deviated pixel identifier for identifying pixels relating to a discharge deviation phenomenon based on the discharge deviation characteristic information acquired by the discharge deviation characteristic information acquirer out of the respective pixels in the M-level image data ($M \geqq 3$) acquired by the image data acquirer; pixel value adjuster for adjusting pixel values of the pixels relating to the discharge deviation phenomenon identified by the deviated pixel identifier; N-level data generator for generating N-level data ($M > N \geqq 2$) for image data in which the pixel value is adjusted by the pixel value adjuster; print data generator for generating print data to which the dots having sizes corresponding to the respective pixels are allocated based on the N-level data generated by the N-level data generator, and printer for executing printing based on the print data generated by the print data generator using the print head.

Accordingly, as in the case of Mode 1, the pixel values of the pixels relating to the banding phenomenon vary and hence the sizes of the dots corresponding to these pixels are changed from the dot sizes of a case in which the banding phenomenon is not occurred. Therefore, the "white bands" or the "dark bands" due to the banding phenomenon caused by a so-called discharge deviation phenomenon can be eliminated effectively or reduced to an almost invisible level.

Most of the printing devices currently in the market such as an inkjet printer include a computer system composed of a central processing unit (CPU), storage devices (RAM, ROM), and an input/output device, and the respective parts can be realized by software using the computer-system. Therefore, the respective parts can be realized economically and easily in comparison with the case in which the respective parts are realized by preparing a specific hardware. In addition, version upgrade by modifying or improving functions can be achieved easily by rewriting part of the program.

Mode 13

In the printing program according to Mode 12, preferably, the deviated pixel identifier identifies a pixel corresponding to a nozzle having the discharge deviation phenomenon, and pixels corresponding to nozzles proximate the nozzle having the discharge deviation phenomenon out of the respective nozzles of the print head, and the pixel value adjuster increases a pixel value of a pixel adjacent to the pixel corresponding to the nozzle having the discharge deviation phenomenon and being at a larger distance therefrom out of the pixels identified by the deviated pixel identifier.

Accordingly, as in the case of Mode 2, the dot size of the pixel adjacent to the pixel corresponding to the nozzle having the discharge deviation phenomenon and being at a larger distance therefrom is increased. Therefore, so called "white bands", which occur between the dot in question and the dot of the pixel corresponding to the nozzle having the discharge deviation phenomenon can be effectively eliminated or reduced to an almost invisible level.

Since the respective parts can be realized by the software using the computer system provided in most of the printing devices currently in the market as in the case of Mode 12, the respective parts can be realized economically and easily in comparison with the case in which the respective parts are realized by preparing a specific hardware. In addition, version upgrade by modifying or improving functions can be achieved easily by rewriting part of the program.

Mode 14

In the printing program according to Mode 12, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster decreases a pixel value of a pixel adjacent to the pixel corresponding to the nozzle having the discharge deviation phenomenon and being at a smaller distance therefrom out of the pixels identified by the deviated pixel identifier.

Accordingly, as in the case of Mode 3, the dot size of the pixel adjacent to the pixel corresponding to the nozzle having the discharge deviation phenomenon and being at a smaller distance therefrom is decreased. Therefore, so called "dark bands", which occur between the dot in question and the dot of the pixel corresponding to the nozzle having the discharge deviation phenomenon can be effectively eliminated or reduced to an almost invisible level.

Since the respective parts can be realized by the software using the computer system provided in most of the printing devices currently in the market as in the case of Mode 12, the respective parts can be realized economically and easily in comparison with the case in which the respective parts are realized by preparing a specific hardware. In addition, version upgrade by modifying or improving functions can be achieved easily by rewriting part of the program.

Mode 15

In the printing program according to Mode 12, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster increases a pixel value of the pixel adjacent to the pixel corresponding to the nozzle having the discharge deviation phenomenon and being at a larger distance therefrom and decreases a pixel value of the pixel adjacent to the pixel corresponding to the nozzle having the discharge deviation phenomenon and being at a smaller distance therefrom out of the pixels identified by the deviated pixel identifier.

Accordingly, as in the case of Mode 4, the dot size of the pixel adjacent to the pixel corresponding to the nozzle having the discharge deviation phenomenon and being at a larger distance therefrom is increased, so called "white bands", which occur between the dot in question and the dot of the pixel corresponding to the nozzle having the discharge deviation phenomenon can be effectively eliminated or reduced to an almost invisible level. Simultaneously, the dot size of the pixel adjacent to the pixel corresponding to the nozzle having the discharge deviation phenomenon and being at a smaller distance therefrom is decreased, so called "dark bands", which occur between the dot in question and the dot of the pixel corresponding to the nozzle having the discharge deviation phenomenon can be effectively eliminated or reduced to an almost invisible level.

Since the respective parts can be realized by the software using the computer system provided in most of the printing devices currently in the market as in the case of Mode 12, the respective parts can be realized economically and easily in comparison with the case in which the respective parts are realized by preparing a specific hardware. In addition, version upgrade by modifying or improving functions can be achieved easily by rewriting part of the program.

Mode 16

In the printing program according to Mode 15, preferably, the pixel value adjuster adjusts the pixel value of the pixel whose pixel value is to be adjusted to eliminate a difference between apparent density of adjacent dots at a larger distance according to a visual sensation and apparent density of adjacent dots at a smaller distance according to the visual sensation.

Accordingly, as in the case of Mode 5, adjustment of the pixel value corresponding to the visual sensation of the viewer is achieved, and hence the banding phenomenon can be alleviated further effectively.

Since the respective parts can be realized by the software using the computer system provided in most of the printing devices currently in the market as in the case of Mode 12, the respective parts can be realized economically and easily in comparison with the case in which the respective parts are realized by preparing a specific hardware. In addition, version upgrade by modifying or improving functions can be achieved easily by rewriting part of the program.

Mode 17

In the printing program according to Mode 16, preferably, the pixel value adjuster sets a space having a density which increases with decrease in distance from the dot and adjusts the pixel value of the pixel to minimize a difference between a maximum density value and a minimum density value in the space when adjusting the pixel value of the pixel being at a larger distance from the adjacent pixel to be larger and the pixel value of the pixel being at a smaller distance from the adjacent pixel to be smaller.

Accordingly, as in the case of Mode 6, by minimizing the density difference in the area where the white bands or the back bands are generated, the dot arrangement in which the visual white bands and black bands are minimized is achieved.

Also, since the respective parts can be realized by the software using the computer system provided in most of the printing devices currently in the market as in the case of Mode 12, the respective parts can be realized economically and easily in comparison with the case in which the respective parts are realized by preparing a specific hardware. In addition, version upgrade by modifying or improving functions can be achieved easily by rewriting part of the program.

Mode 18

In the printing program according to any one of Mode 12 to Mode 17, preferably, the printing program includes amount of displacement detector for detecting an amount of positional displacement at which the dot of the pixel corresponding to the nozzle having the discharge deviation phenomenon is actually printed, and the pixel value adjuster calculates the amount of adjustment of the pixel value of the pixel to be adjusted based on the amount of positional displacement of the dot of the pixel corresponding to the nozzle having the discharge deviation phenomenon detected by the amount of displacement detector.

Accordingly, as in the case of Mode 7, the amount of displacement of the dot corresponding to the pixel formed as a result of the discharge deviation phenomenon can be obtained accurately, and hence an accurate pixel value adjustment is achieved.

Since the respective parts can be realized by the software using the computer system provided in most of the printing devices currently in the market as in the case of Mode 12, the respective parts can be realized economically and easily in comparison with the case in which the respective parts are realized by preparing a specific hardware. In addition, version upgrade by modifying or improving functions can be achieved easily by rewriting part of the program.

Mode 19

In the printing program according to Mode 18, preferably, the amount of displacement detector detects the amount of positional displacement of the dot of the pixel corresponding to the nozzle having the discharge deviation phenomenon based on a density distribution of a dot pattern printed using the print head, and calculates the inter-dot distance.

Accordingly, as in the case of Mode 8, the amount of displacement can be obtained accurately even when the read density distribution of the dot pattern printed using the print head is ambiguous. Since the reading accuracy (resolution) of the reading device such as a scanner which reads the dot pattern can be reduced significantly, a reading device of low cost can be used, and hence the cost required for calculating the amount of displacement can be reduced significantly.

Since the respective parts can be realized by the software using the computer system provided in most of the printing devices currently in the market as in the case of Mode 12, the respective parts can be realized economically and easily in comparison with the case in which the respective parts are realized by preparing a specific hardware. In addition, version upgrade by modifying or improving functions can be achieved easily by rewriting part of the program.

Mode 20

In the printing program according to any one of Mode 12 to Mode 19, preferably, the N-level data generator uses an error diffusion method or a dither method when converting the image data in which the pixel value is adjusted by the pixel value adjuster into N-level image data.

Accordingly, as in the case of Mode 9, the high-definition printed material in which the intermediate gradations of the original image data are faithfully expressed can reliably be obtained.

Since the respective parts can be realized by the software using the computer system provided in most of the printing devices currently in the market as in the case of Mode 12, the respective parts can be realized economically and easily in comparison with the case in which the respective parts are realized by preparing a specific hardware. In addition, version upgrade by modifying or improving functions can be achieved easily by rewriting part of the program.

Mode 21

A computer readable recording medium according to Mode 21 is a computer readable recording medium in which the printing program stated in any one of Mode 12 to Mode 20 is stored.

Accordingly, the printing program as stated in any one of Mode 12 to Mode 20 can be provided easily and reliably for a consumer such as a user via the computer readable recording medium such as a CD-ROM, a DVD-ROM, an FD, or a semiconductor chip.

Mode 22

A printing method according to Mode 22 includes: a discharge deviation characteristic information acquiring step for acquiring discharge deviation characteristic information of nozzles in a print head having a plurality of the nozzles which can print dots in different sizes; an image data acquiring step for acquiring M-level image data ($M \geqq 3$); a deviated pixel identifying step for identifying pixels relating to a discharge deviation phenomenon based on the discharge deviation characteristic information acquired by the discharge deviation characteristic information acquiring step out of the respective pixels in the M-level image data ($M \geqq 3$) acquired by the image data acquiring step; a pixel value adjusting step for adjusting pixel values of the pixels relating to the discharge deviation phenomenon identified by the deviated pixel identifying step; an N-level data generating step for generating N-level data ($M > N \geqq 2$) for image data in which the pixel value is adjusted by the pixel value adjusting step; a print data generating step for generating the print data to which the dots having sizes corresponding to the respective pixels are allocated based on the N-level data generated by the N-level data generating step; and a printing step for executing printing based on the print data generated by the print data generating step.

Accordingly, as in the case of Mode 1, the pixel values of the pixels relating to the banding phenomenon vary and hence the sizes of the dots corresponding to these pixels are changed from the dot sizes of a case in which the banding phenomenon is not occurred. Therefore, "white bands" or "dark bands" due to the banding phenomenon caused by a so-called discharge deviation phenomenon can be eliminated effectively or reduced to an almost invisible level.

Most of the printing devices currently in the market such as an inkjet printer include a computer system composed of a central processing unit (CPU), storage devices (RAM, ROM), and an input/output device, and the respective steps can be realized by a software using the computer system. Therefore, the respective steps can be realized economically and easily in comparison with the case in which the respective parts are realized by preparing a specific hardware. In addition, version upgrade by modifying or improving functions can be achieved easily by rewriting part of the program.

Mode 23

In the printing method according to Mode 22, preferably, the deviated pixel identifying step identifies a pixel corresponding to a nozzle having the discharge deviation phenomenon, and pixels corresponding to nozzles proximate the nozzle having the discharge deviation phenomenon out of the respective nozzles of the print head, and the pixel value adjusting step increases a pixel value of a pixel adjacent to the pixel corresponding to the nozzle having the discharge deviation phenomenon and being at a larger distance therefrom out of the pixels identified by the deviated pixel identifying step.

Accordingly, as in the case of Mode 2, the dot size of the pixel adjacent to the pixel corresponding to the nozzle having the discharge deviation phenomenon and being at a larger distance therefrom is increased. Therefore, so called "white bands", which occur between the dot in question and the dot of the pixel corresponding to the nozzle having the discharge deviation phenomenon can be effectively eliminated or reduced to an almost invisible level.

Since the respective steps can be realized by the software using the computer system provided in most of the printing devices currently in the market as in the case of Mode 22, the respective steps can be realized economically and easily in comparison with the case in which the respective parts are realized by preparing a specific hardware. In addition, version upgrade by modifying or improving functions can be achieved easily by rewriting part of the program.

Mode 24

In the printing method according to Mode 22, preferably, the deviated pixel identifying step identifies a pixel corresponding to the nozzle having the discharge deviation phenomenon and pixels corresponding to nozzles proximate the nozzle having the discharge deviation phenomenon out of the respective nozzles of the print head, and a pixel value adjusting step decreases a pixel value of the pixel adjacent to the pixel corresponding to the nozzle having the discharge deviation phenomenon and being at a smaller distance therefrom out of the pixels identified by the deviated pixel identifying step.

Accordingly, as in the case of Mode 3, the dot size of the pixel adjacent to the pixel corresponding to the nozzle having the discharge deviation phenomenon and being at a smaller distance therefrom is decreased. Therefore, so called "dark bands", which occur between the dot in question and the dot of the pixel corresponding to the nozzle having the discharge deviation phenomenon can be effectively eliminated or reduced to an almost invisible level.

Since the respective steps can be realized by the software using the computer system provided in most of the printing devices currently in the market as in the case of Mode 22, the respective steps can be realized economically and easily in comparison with the case in which the respective parts are realized by preparing a specific hardware. In addition, version upgrade by modifying or improving functions can be achieved easily by rewriting part of the program.

Mode 25

In the printing method according to Mode 22, preferably, the deviated pixel identifying step identifies a pixel corresponding to a nozzle having the discharge deviation phenomenon and pixels corresponding to nozzles proximate the nozzle having the discharge deviation phenomenon out of the respective nozzles of the print head, and the pixel value adjusting step increases a pixel value of a pixel adjacent to the pixel corresponding to the nozzle having the discharge deviation phenomenon and being at a larger distance therefrom and decreases a pixel value of a pixel adjacent to the pixel corresponding to the nozzle having the discharge deviation phenomenon and being at a shorter distance therefrom out of the pixels identified by the deviated pixel identifying step.

Accordingly, as in the case of Mode 4, the dot size of the pixel adjacent to the pixel corresponding to the nozzle having the discharge deviation phenomenon and being at a larger distance therefrom is increased, so called "white bands", which occur between the dot in question and the dot of the pixel corresponding to the nozzle having the discharge deviation phenomenon can be effectively eliminated or reduced to an almost invisible level. Simultaneously, the dot size of the pixel adjacent to the pixel corresponding to the nozzle having the discharge deviation phenomenon and being at a smaller distance therefrom is decreased, so called "dark bands", which occur between the dot in question and the dot of the pixel corresponding to the nozzle having the discharge deviation phenomenon can be effectively eliminated or reduced to an almost invisible level.

Since the respective steps can be realized by the software using the computer system provided in most of the printing devices currently in the market as in the case of Mode 22, the respective steps can be realized economically and easily in comparison with the case in which the respective steps are realized by preparing a specific hardware. In addition, version upgrade by modifying or improving functions can be achieved easily by rewriting part of the program.

Mode 26

In the printing method according to Mode 25, preferably, the pixel value adjusting step adjusts the pixel value of the pixel whose pixel value is to be adjusted to eliminate the visual difference between apparent density of adjacent dots at a larger distance according to a visual sensation and apparent density of adjacent dots at a smaller distance according to the visual sensation.

Accordingly, as in the case of Mode 5, adjustment of the pixel value corresponding to the visual sensation of the viewer is achieved, and hence the banding phenomenon can be alleviated further effectively.

Since the respective parts can be realized by the software using the computer system provided in most of the printing devices currently in the market as in the case of Mode 22, the respective parts can be realized economically and easily in comparison with the case in which the respective steps are realized by preparing a specific hardware. In addition, version upgrade by modifying or improving functions can be achieved easily by rewriting part of the program.

Mode 27

In the printing method according to Mode 26, preferably, the pixel value adjusting step sets a space having a density which increases with decrease in distance from the dot and adjusts the pixel value of the pixel to minimize a difference between a maximum density value and a minimum density value in the space when adjusting the pixel value of the pixel being at a larger distance from the adjacent pixel to be larger and the pixel value of the pixel being at a smaller distance from the adjacent pixel to be smaller.

Accordingly, as in the case of Mode 6, by minimizing the density difference in the area where the white bands or the back bands are generated, the dot arrangement in which the visual white bands and black bands are minimized is achieved.

Also, since the respective steps can be realized by the software using the computer system provided in most of the printing devices currently in the market as in the case of Mode 22, the respective steps can be realized economically and easily in comparison with the case in which the respective steps are realized by preparing a specific hardware. In addition, version upgrade by modifying or improving functions can be achieved easily by rewriting part of the program.

Mode 28

In the printing method according to any one of Mode 22 to Mode 27, preferably, the printing method includes an amount of displacement detecting step for detecting an amount of positional displacement at which the dot of the pixel corresponding to the nozzle having the discharge deviation phenomenon is actually printed, and the pixel value adjusting step calculates the amount of adjustment of the pixel value of the pixel to be adjusted based on an amount of positional displacement of the dot of the pixel corresponding to the nozzle having the discharge deviation phenomenon detected by the amount of displacement detecting step.

Accordingly, as in the case of Mode 7, the amount of displacement of the dot corresponding to the pixel formed as a result of the discharge deviation phenomenon can be obtained accurately, and hence an accurate pixel value adjustment is achieved.

Since the respective steps can be realized by the software using the computer system provided in most of the printing devices currently in the market as in the case of Mode 22, the respective steps can be realized economically and easily in comparison with the case in which the respective parts are realized by preparing a specific hardware. In addition, version upgrade by modifying or improving functions can be achieved easily by rewriting part of the program.

Mode 29

In the printing method according to Mode 28, preferably, the amount of displacement detecting step detects the amount of positional displacement of the dot of the pixel corresponding to the nozzle having the discharge deviation phenomenon based on a density distribution of a dot pattern printed using the print head, and calculates an inter-dot distance.

Accordingly, as in the case of Mode 8, the amount of displacement can be obtained accurately even when the read density distribution of the dot pattern printed using the print head is ambiguous. Since the reading accuracy (resolution) of the reading device such as a scanner which read the dot pattern can be reduced significantly, a reading device of low cost can be used, and hence the cost required for calculating the amount of displacement can be reduced significantly.

Since the respective steps can be realized by the software using the computer system provided in most of the printing devices currently in the market as in the case of Mode 22, the respective steps can be realized economically and easily in comparison with the case in which the respective parts are realized by preparing a specific hardware. In addition, version upgrade by modifying or improving functions can be achieved easily by rewriting part of the program.

Mode 30

The printing method according to any one of Mode 22 to Mode 29, preferably, the N-level data generating step uses an error diffusion method or a dither method when converting the image data in which the pixel value is adjusted by the pixel value adjusting step into N-level image data.

Accordingly, as in the case of Mode 9, the high-definition printed material in which intermediate gradations of the original image data are faithfully expressed can reliably be obtained.

Since the respective steps can be realized by the software using the computer system provided in most of the printing devices currently in the market as in the case of Mode 22, the respective steps can be realized economically and easily in comparison with the case in which the respective parts are realized by preparing a specific hardware. In addition, version upgrade by modifying or improving functions can be achieved easily by rewriting part of the program.

Mode 31

An image processing device according to Mode 31 includes: discharge deviation characteristic information acquirer for acquiring discharge deviation characteristic information of nozzles in a print head having a plurality of the nozzles which can print dots in different sizes; image data acquirer for acquiring M-level image data ($M>3$); deviated pixel identifier for identifying pixels relating to a discharge deviation phenomenon based on the discharge deviation characteristic information acquired by the discharge deviation characteristic information acquirer out of the respective pixels in the M-level image data ($M\geqq3$) acquired by the image data acquirer; pixel value adjuster for adjusting a pixel value of the pixels relating to the discharge deviation phenomenon identified by the deviated pixel identifier; N-level data generator for generating N-level data ($M>N\geqq2$) for the image data in which the pixel value is adjusted by the pixel value adjuster; and print data generator for generating the print data to which the dots having sizes corresponding to the respective pixels are allocated based on the N-level data generated by the N-level data generator.

Accordingly, the pixel values of the pixels relating to a banding phenomenon vary and hence the sizes of the dots corresponding to these pixels are changed from the dot sizes of a case in which the banding phenomenon is not occurred. Therefore, "white bands" or "dark bands" due to the banding phenomenon caused by a so-called discharge deviation phenomenon can be eliminated effectively or reduced to an almost invisible level.

Since the respective parts can be realized on the software, it can be realized by the information processing device such as a multi-purpose personal computer.

Mode 32

In the image processing device according to Mode 31, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster increases a pixel value of a pixel adjacent to the pixel corresponding to the nozzle having the discharge deviation phenomenon and being at a larger distance therefrom out of the pixels identified by the deviated pixel identifier.

Accordingly, since the dot size of the pixel adjacent to the pixel corresponding to the nozzle having the discharge deviation phenomenon and being at a larger distance therefrom is increased, print data in which so called "white bands", which occur between the dot in question and the dot corresponding to the nozzle having the discharge deviation phenomenon can be effectively eliminated or reduced to an almost invisible level can be obtained.

Mode 33

In the image processing device according to Mode 31, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and a pixel value adjuster decreases a pixel value of the pixel adjacent to the pixel corresponding to the nozzle having the discharge deviation phenomenon and being at a smaller distance therefrom out of the pixels identified by the deviated pixel identifier.

Accordingly, since the dot size of the pixel adjacent to the pixel corresponding to the nozzle having the discharge deviation phenomenon and being at a smaller distance therefrom is decreased, print data in which so called "dark bands", which occur between the dot in question and the dot corresponding to the nozzle having the discharge deviation phenomenon can be effectively eliminated or reduced to an almost invisible level can be obtained.

As in the case of Mode 31, since the respective parts can be realized on the software, it can be realized by the information processing device such as a multi-purpose personal computer.

Mode 34

In the image processing device according to Mode 31, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster is adjusted to increase a pixel value of a pixel adjacent to the pixel corresponding to the nozzle having the discharge deviation phenomenon and being at a larger distance therefrom and decreases the pixel value of the pixel adjacent to the pixel corresponding to the nozzle having the discharge deviation phenomenon and being at a smaller distance therefrom out of the pixels identified by the deviated pixel identifier.

Accordingly, the dot size of the pixel adjacent to the pixel corresponding to the nozzle having the discharge deviation phenomenon and being at a larger distance therefrom is increased, so called "white bands", which occur between the dot in question and the dot of the pixel corresponding to the nozzle having the discharge deviation phenomenon can be effectively eliminated or reduced to an almost invisible level and, simultaneously, the dot size of the pixel adjacent to the pixel corresponding to the nozzle having the discharge deviation phenomenon and being at a smaller distance therefrom is decreased. Therefore, print data in which so called "dark bands", which occur between the dot in question and the dot of the pixel corresponding to the nozzle having the discharge deviation phenomenon can be effectively eliminated or reduced to an almost invisible level can be obtained.

As in the case of Mode 31, since the respective parts can be realized on the software, it can be realized by the information processing device such as a multi-purpose personal computer.

Mode 35

The image processing device according to Mode 34, preferably, the pixel value adjuster adjusts the pixel value of the pixel whose pixel value is to be adjusted to eliminate a difference between apparent density of adjacent dots at a larger distance according to a visual sensation and apparent density of adjacent dots at a smaller distance according to the visual sensation.

Accordingly, adjustment of the pixel value corresponding to the visual sensation of a viewer is achieved, and hence the banding phenomenon can be alleviated further effectively.

As in the case of Mode 31, since the respective parts can be realized on the software, it can be realized by the information processing device such as a multi-purpose personal computer.

Mode 36

The image processing device according to Mode 35, preferably, the pixel value adjuster sets a space having a density which increases with decrease in distance from the dot and adjusts the pixel value of the pixel to minimize a difference between a maximum density value and a minimum density value in the space when adjusting the pixel value of the pixel being at a larger distance from the adjacent pixel to be larger and the pixel value of the pixel being at a smaller distance from the adjacent pixel to be smaller.

Accordingly, by minimizing the density difference in the area where the white bands or the back bands are generated, the dot arrangement in which the visual white bands and black bands are minimized is achieved.

As in the case of Mode 31, since the respective parts can be realized on the software, it can be realized by the information processing device such as a multi-purpose personal computer.

Mode 37

The image processing device according to any one of Mode 31 to Mode 36 includes amount of displacement detector for detecting an amount of positional displacement at which the dot of the pixel corresponding to the nozzle having the discharge deviation phenomenon is actually printed, and the pixel value adjuster calculates the amount of adjustment of the pixel value of the pixel to be adjusted based on the amount of positional displacement of the dot of the pixel corresponding to the nozzle having the discharge deviation phenomenon detected by the amount of displacement detector.

Accordingly, the amount of displacement of the dot corresponding to the pixel formed as a result of the discharge deviation phenomenon can be obtained accurately, and hence an accurate pixel value adjustment is achieved.

As in the case of Mode 31, since the respective parts can be realized on the software, it can be realized by the information processing device such as a multi-purpose personal computer.

Mode 38

In the image processing device according to Mode 37, preferably, the amount of displacement detector detects the amount of positional displacement of the dot of the pixel corresponding to the nozzle having the discharge deviation phenomenon based on a density distribution of a dot pattern printed using the print head, and calculates the inter-dot distance.

Accordingly, the amount of displacement can be obtained accurately even when the read density distribution of the dot pattern printed using the print head is ambiguous. Since reading accuracy (resolution) of a reading device such as a scanner which reads the dot pattern can be reduced significantly, a reading device of low cost can be used, and hence a cost required for calculating the amount of displacement can be reduced significantly.

As in the case of Mode 31, since the respective parts can be realized on the software, it can be realized by the information processing device such as a multi-purpose personal computer.

Mode 39

The image processing device according to any one of Mode 31 to Mode 38, preferably, the N-level data generator uses an error diffusion method or a dither method when converting the image data in which the pixel value is adjusted by the pixel value adjuster into N-level image data.

Accordingly, the high-definition printed material in which the intermediate gradations of the original image data are faithfully expressed can reliably be obtained.

As in the case of Mode 31, since the respective parts can be realized on the software, it can be realized by the information processing device such as a multi-purpose personal computer.

Mode 40

An image processing program according to Mode 40 causes a computer to function as discharge deviation characteristic information acquirer for acquiring discharge deviation characteristic information of nozzles in a print head having a plurality of the nozzles which can print dots in different sizes; image data acquirer for acquiring M-level image data ($M \geqq 3$); deviated pixel identifier for identifying pixels relating to a discharge deviation phenomenon based on the discharge deviation characteristic information acquired by the discharge deviation characteristic information acquirer out of the respective pixels in the M-level image data ($M \geqq 3$) acquired by the image data acquirer; pixel value adjuster for adjusting pixel values of the pixels relating to the discharge deviation phenomenon identified by the deviated pixel identifier; N-level data generator for generating N-level data ($M > N \geqq 2$) for the image data in which the pixel value is adjusted by the pixel value adjuster; and print data generator for generating print data to which the dots having sizes corresponding to the respective pixels are allocated based on the N-level data generated by the N-level data generator.

Accordingly, as in the case of Mode 31, the pixel values of the pixels relating to the banding phenomenon vary and hence the sizes of the dots corresponding to these pixels are changed from the dot sizes of a case in which a banding phenomenon is not occurred. Therefore, "white bands" or "dark bands" due to the banding phenomenon caused by a so-called discharge deviation phenomenon can be eliminated effectively or reduced to an almost invisible level.

Since the respective parts can be realized by the software using a multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 41

In the image processing program according to Mode 40, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster increases a pixel value of a pixel adjacent to the pixel corresponding to the nozzle having the discharge deviation phenomenon and being at a larger distance therefrom out of the pixels identified by the deviated pixel identifier.

Accordingly, as in the case of Mode 32, since the dot size of the pixel adjacent to the pixel corresponding to the nozzle having the discharge deviation phenomenon and being at a larger distance therefrom is increased, print data in which so called "white bands", which occur between the dot in question and the dot of the pixel corresponding to the nozzle having the discharge deviation phenomenon can be effectively eliminated or reduced to an almost invisible level can be obtained.

As in the case of Mode 40, since the respective parts can be realized by the software using the multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 42

In the image processing program according to Mode 40, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster decreases a pixel value of a pixel adjacent to the pixel corresponding to the nozzle having the discharge deviation phenomenon and being at a smaller distance therefrom out of the pixels identified by the deviated pixel identifier.

Accordingly, as in the case of Mode 33, since the dot size of the pixel adjacent to the pixel corresponding to the nozzle having the discharge deviation phenomenon and being at a smaller distance therefrom is decreased, so called "dark bands", which occur between the dot in question and the dot of the pixel corresponding to the nozzle having the discharge deviation phenomenon can be effectively eliminated or reduced to an almost invisible level.

As in the case of Mode 40, since the respective parts can be realized by the software using the multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 43

In the image processing program according to Mode 40, preferably, the deviated pixel identifier identifies a pixel corresponding to a nozzle having the discharge deviation phenomenon and pixels corresponding to nozzles proximate the nozzle having the discharge deviation phenomenon out of the respective nozzles of the print head, and the pixel value adjuster increases a pixel value of a pixel adjacent to the pixel corresponding to the nozzle having the discharge deviation phenomenon and being at a larger distance therefrom and decreases the pixel value of the pixel adjacent to the pixel corresponding to the nozzle having the discharge deviation phenomenon and being at a smaller distance therefrom out of the pixels identified by the deviated pixel identifier.

Accordingly, as in the case of Mode 34, the dot size of the pixel adjacent to the pixel corresponding to the nozzle having the discharge deviation phenomenon and being at a larger distance therefrom is increased, so called "white bands", which occur between the dot in question and the dot corresponding to the nozzle having the discharge deviation phenomenon can be effectively eliminated or reduced to an almost invisible level and, simultaneously, the dot size of the pixel adjacent to the pixel corresponding to the nozzle having the discharge deviation phenomenon and being at a smaller distance therefrom is decreased. Therefore, so called "dark bands", which occur between the dot in question and the dot of the pixel corresponding to the nozzle having the discharge deviation phenomenon can be effectively eliminated or reduced to an almost invisible level.

As in the case of Mode 40, since the respective parts can be realized by the software using the multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 44

In the image processing program according to Mode 43, preferably, the pixel value adjuster adjusts the pixel value of the pixel whose pixel value is to be adjusted to eliminate a visual difference between apparent density of adjacent dots at a larger distance according to a visual sensation and apparent density of adjacent dots at a smaller distance according to a visual sensation.

Accordingly, as in the case of Mode 35, adjustment of the pixel value corresponding to the visual sensation of the viewer is achieved, and hence the banding phenomenon can be alleviated further effectively.

As in the case of Mode 40, since the respective parts can be realized by the software using the multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 45

In the image processing program according to Mode 44, preferably, the pixel value adjuster sets a space having a density which increases with decrease in distance from the dot and adjusts the pixel value of the pixel to minimize a difference between a maximum density value and a minimum density value in the space when adjusting the pixel value of the pixel being at a larger distance from the adjacent pixel to be larger and the pixel value of the pixel being at a smaller distance from the adjacent pixel to be smaller.

Accordingly, as in the case of Mode 36, by minimizing the density difference in the area where the white bands or the back bands are generated, the dot arrangement in which the visual white bands and black bands are minimized is achieved.

As in the case of Mode 40, since the respective parts can be realized by the software using the multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 46

The image processing program according to any one of Mode 40 to Mode 45 includes amount of displacement detector for detecting an amount of positional displacement at which the dot of the pixel corresponding to the nozzle having the discharge deviation phenomenon is actually printed, and the pixel value adjuster calculates the amount of adjustment of the pixel value of the pixel to be adjusted based on the amount of positional displacement of the dot of the pixel corresponding to the nozzle having the discharge deviation phenomenon detected by the amount of displacement detector.

Accordingly, as in the case of Mode 37, the amount of displacement of the dot corresponding to the pixel formed as a result of the discharge deviation phenomenon can be obtained accurately, and hence an accurate pixel value adjustment is achieved.

As in the case of Mode 40, since the respective parts can be realized by the software using the multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 47

In the image processing program according to Mode 46, preferably, the amount of displacement detector detects the amount of positional displacement of the dot of the pixel corresponding to the nozzle having the discharge deviation phenomenon based on a density distribution of a dot pattern printed using the print head, and calculates the inter-dot distance.

Accordingly, as in the case of Mode 38, the amount of displacement can be obtained accurately even when the read density distribution of the dot pattern printed using the print head is ambiguous. Since the reading accuracy (resolution) of the reading device such as a scanner which reads the dot pattern can be reduced significantly, a reading device of low cost can be used, and hence the cost required for calculating the amount of displacement can be reduced significantly.

As in the case of Mode 40, since the respective parts can be realized by the software using the multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 48

In the image processing program according to any one of Mode 40 to Mode 47, the N-level data generator uses an error diffusion method or a dither method when converting the image data in which the pixel value is adjusted by the pixel value adjuster into N-level image data.

Accordingly, as in the case of Mode 39, the high-definition printed material in which the intermediate gradations of the original image data are faithfully expressed can reliably be obtained.

As in the case of Mode 40, since the respective parts can be realized by the software using the multi-purpose computer system such as a personal computer (PC), the respective parts can be realized economically and easily in comparison with the case in which the respective parts are realized by preparing a specific hardware. In addition, version upgrade by modifying or improving functions can be achieved easily by rewriting part of the program.

Mode 49

A computer readable recording medium according to Mode 49 is a computer readable recording medium in which the image processing program stated in any one of Mode 40 to Mode 48 is stored.

Accordingly, the image processing program as stated in any one of Mode 40 to Mode 48 can be provided easily and reliably for a consumer such as a user via the computer readable recording medium such as a CD-ROM, a DVD-ROM, an FD, or a semiconductor chip.

Mode 50

An image processing method according to Mode 50 includes: a discharge deviation characteristic information acquiring step for acquiring discharge deviation characteristic information of nozzles in a print head having a plurality of the nozzles which can print dots in different sizes; an image data acquiring step for acquiring M-level image data ($M \geqq 3$); a deviated pixel identifying step for identifying pixels relating to a discharge deviation phenomenon based on the discharge deviation characteristic information acquired by the discharge deviation characteristic information acquiring step out of the respective pixels in the M-level image data ($M \geqq 3$) acquired by the image data acquiring step; a pixel value adjusting step for adjusting pixel values of the pixels relating to the discharge deviation phenomenon identified by the deviated pixel identifying step; an N-level data generating step for generating N-level data ($M > N \geqq 2$) for the image data in which the pixel value is adjusted by the pixel value adjusting step; and a print data generating step for generating the print data to which the dots having sizes corresponding to the respective pixels are allocated based on the N-level data generated by the N-level data generating step.

Accordingly, as in the case of Mode 31, the pixel values of the pixels relating to the banding phenomenon vary and hence the sizes of the dots corresponding to these pixels are changed from the dot sizes of a case in which the banding phenomenon is not occurred. Therefore, "white bands" or "dark bands" due to the banding phenomenon caused by a so-called discharge deviation phenomenon can be eliminated effectively or reduced to an almost invisible level.

Mode 51

In the image processing method according to Mode 50, preferably, the deviated pixel identifying step identifies a pixel corresponding to a nozzle having the discharge deviation phenomenon, and pixels corresponding to nozzles proximate the nozzle having the discharge deviation phenomenon out of the respective nozzles of the print head, and the pixel value adjusting step increases the pixel value of the pixel adjacent to the pixel corresponding to the nozzle having the discharge deviation phenomenon and being at a larger distance therefrom out of the pixels identified by the deviated pixel identifying step.

Accordingly, as in the case of Mode 32, the dot size of the pixel adjacent to the pixel corresponding to the nozzle having the discharge deviation phenomenon and being at a larger distance therefrom is increased. Therefore, so called "white bands", which occur between the dot in question and the dot of the pixel corresponding to the nozzle having the discharge deviation phenomenon can be effectively eliminated or reduced to an almost invisible level.

Mode 52

In the image processing method according to Mode 50, preferably, the deviated pixel identifying step identifies a pixel corresponding to the nozzle having the discharge deviation phenomenon and pixels corresponding to nozzles proximate the nozzle having the discharge deviation phenomenon out of the respective nozzles of the print head, and the pixel value adjusting step decreases the pixel value of the pixel adjacent to the pixel corresponding to the nozzle having the discharge deviation phenomenon and being at a smaller distance therefrom out of the pixels identified by the deviated pixel identifier.

Accordingly, as in the case of Mode 33, the dot size of the pixel adjacent to the pixel corresponding to the nozzle having the discharge deviation phenomenon and being at a smaller distance therefrom is decreased. Therefore, so called "dark bands", which occur between the dot in question and the dot of the pixel corresponding to the nozzle having the discharge deviation phenomenon can be effectively eliminated or reduced to an almost invisible level.

Mode 53

In the image processing method according to Mode 50, preferably, the deviated pixel identifying step identifies a pixel corresponding to a nozzle having the discharge deviation phenomenon and pixels corresponding to nozzles proximate the nozzle having the discharge deviation phenomenon out of the respective nozzles of the print head, and the pixel value adjusting step increases the pixel value of the pixel adjacent to the pixel corresponding to the nozzle having the discharge deviation phenomenon and being at a larger distance therefrom and decreases the pixel value of the pixel adjacent to the pixel corresponding to the nozzle having the discharge deviation phenomenon and being at a shorter distance therefrom out of the pixels identified by the deviated pixel identifying step.

Accordingly, as in the case of Mode 34, the dot size of the pixel adjacent to the pixel corresponding to the nozzle having the discharge deviation phenomenon and being at a larger distance therefrom is increased, so called "white bands", which occur between the dot in question and the dot of the pixel corresponding to the nozzle having the discharge deviation phenomenon can be effectively eliminated or reduced to an almost invisible level. Simultaneously, the dot size of the pixel adjacent to the pixel corresponding to the nozzle having the discharge deviation phenomenon and being at a smaller distance therefrom is decreased, so called "dark bands", which occur between the dot in question and the dot corresponding to the nozzle having the discharge deviation phenomenon can be effectively eliminated or reduced to an almost invisible level.

Mode 54

In the image processing method according to Mode 53, preferably, the pixel value adjusting step adjusts the pixel value of the pixel whose pixel value is to be adjusted to eliminate a difference between apparent density of adjacent dots at a larger distance according to a visual sensation and apparent density of adjacent dots at a smaller distance according to the visual sensation.

Accordingly, as in the case of Mode 35, adjustment of the pixel value corresponding to the visual sensation of the viewer is achieved, and hence the banding phenomenon can be alleviated further effectively.

Mode 55

In the image processing method according to Mode 54, preferably, the pixel value adjusting step sets a space having a density which increases with decrease in distance from the dot and adjusts the pixel value of the pixel to minimize a difference between a maximum density value and a minimum density value in the space when adjusting the pixel value of the pixel being at a larger distance from the adjacent pixel to be larger and the pixel value of the pixel being at a smaller distance from the adjacent pixel to be smaller.

Accordingly, as in the case of Mode 36, by minimizing the density difference in the area where the white bands or the back bands are generated, the dot arrangement in which the visual white bands and black bands are minimized is achieved.

Mode 56

The image processing method according to any one of Mode 50 to Mode 55, preferably, includes an amount of displacement detecting step for detecting an amount of positional displacement at which the dot of the pixel corresponding to the nozzle having the discharge deviation phenomenon is actually printed, and the pixel value adjusting step calculates the amount of adjustment of the pixel value of the pixel to be adjusted based on the amount of positional displacement of the dot of the pixel corresponding to the nozzle having the discharge deviation phenomenon detected by the amount of displacement detecting step.

Accordingly, as in the case of Mode 37, the amount of displacement of the dot corresponding to the pixel formed as a result of the discharge deviation phenomenon can be obtained accurately, and hence an accurate pixel value adjustment is achieved.

Mode 57

In the image processing method according to Mode 56, preferably, the amount of displacement detecting step detects the amount of positional displacement of the dot of the pixel corresponding to the nozzle having the discharge deviation phenomenon based on a density distribution of a dot pattern printed using the print head, and calculates the inter-dot distance.

Accordingly, as in the case of Mode 38, the amount of displacement can be obtained accurately even when the read density distribution of the dot pattern printed using the print head is ambiguous. Since the reading accuracy (resolution) of the reading device such as a scanner which reads the dot pattern can be reduced significantly, a reading device of low cost can be used, and hence the cost required for calculating the amount of displacement can be reduced significantly.

Mode 58

In the image processing method according to any one of Mode 50 to Mode 57, preferably, the N-level data generating step uses an error diffusion method or a dither method when converting the image data in which the pixel value is adjusted by the pixel value adjusting step into N-level image data.

Accordingly, as in the case of Mode 39, print data in which apparent reduction of density occurred by increase in the inter-dot distance is compensated can be obtained.

BRIEF DESCRIPTION OF THE DRAWINGS

The invention will be described with reference to the accompanying drawings, wherein like numbers reference like elements.

FIG. 7 is a drawing showing an example of discharge deviation characteristic information.

FIGS. 12A and 12B are drawing showing a normal dot pattern and a dot pattern in which the discharge deviation is partly occurred.

FIGS. 13A and 13B are conceptual drawings showing an example of adjustment of a pixel value relating to the discharge deviation phenomenon.

FIGS. 14A and 14B are conceptual drawing in which a relation of density areas that the respective pixels should express is expressed in areas.

DESCRIPTION OF EXEMPLARY EMBODIMENTS

Referring now to the attached drawings, exemplary embodiments of the invention will be described in detail.

FIG. 1 to FIG. 21 show embodiments relating to a printing device 100, a printing program, a printing method, an image processing device, an image processing program, an image processing method, and a recording medium which is readable by a computer.

Figure 1:
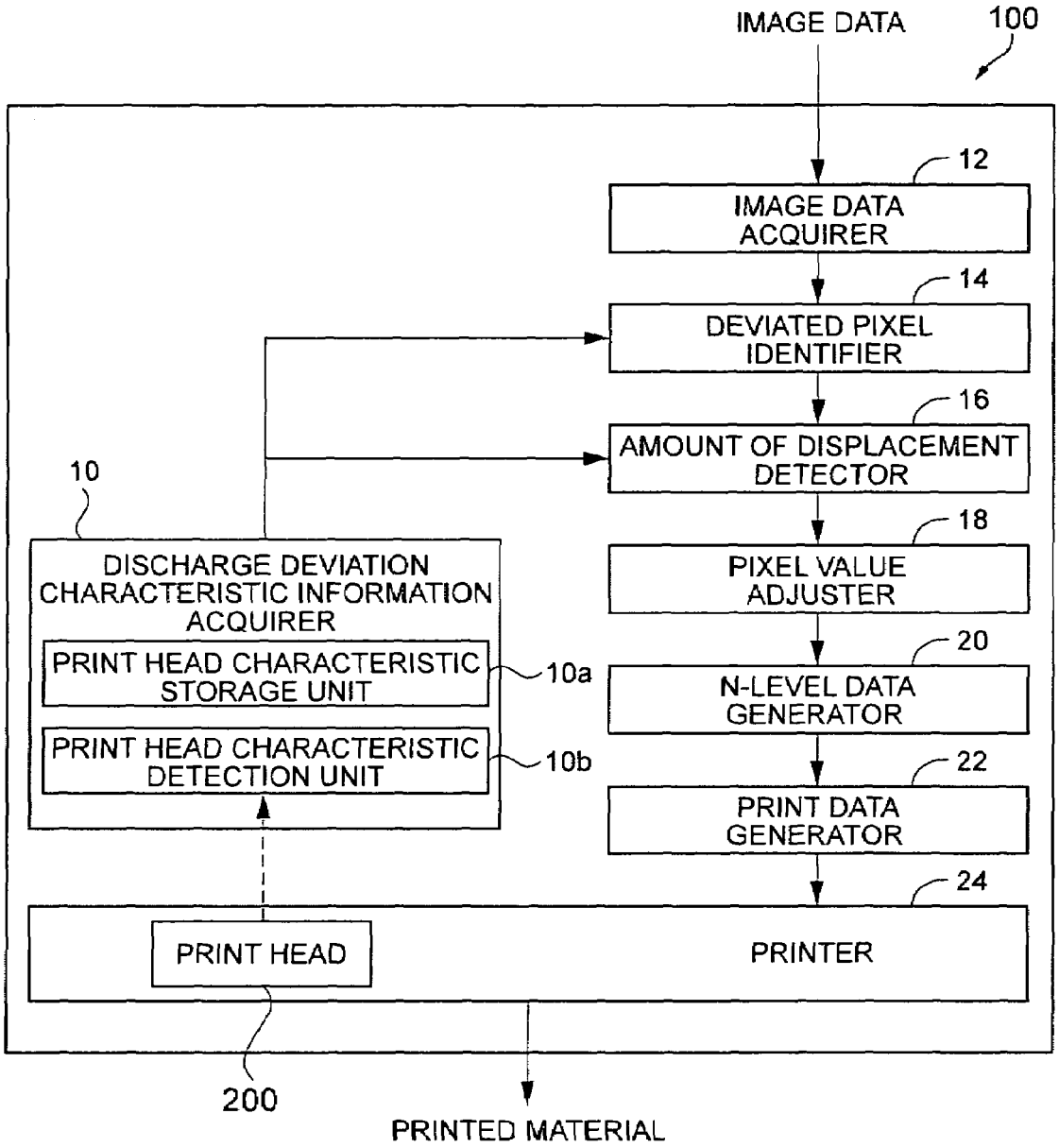
FIG. 1 is a functional block diagram showing an embodiment of a printing device according to the invention.

FIG. 1 is a functional block diagram showing the printing device 100 according to a first embodiment of the invention.

As shown in the drawing, the printing device 100 mainly includes a print head 200 that can print dots of different sizes, discharge deviation characteristic information acquirer 10 for acquiring discharge deviation characteristic information of the print head 200, image data acquirer 12 for acquiring multi-level image data, deviated pixel identifier 14 for identifying pixels relating to a discharge deviation phenomenon by comparing an amount of discharge deviation and a predetermined threshold out of respective pixels in the multi-level image data acquired by the image data acquirer 12, amount of displacement detector 16 for detecting an amount of positional displacement of the pixels relating to the discharge deviation phenomenon identified by the deviated pixel identifier 14, pixel value adjuster 18 for adjusting pixel values of the pixels relating to the discharge deviation phenomenon identified by the deviated pixel identifier 14 based on the amount of positional displacement detected by the amount of displacement detector 16, N-level data generator 20 for generating N-level data ($M>N\geqq 2$) for image data in which the pixel values are adjusted by the pixel value adjuster 18, print data generator 22 for generating print data in which dots of sizes corresponding to the respective pixels are allocated based on the N-level data generated by the N-level data generator 20, and printer 24 for executing printing based on the print data generated by the print data generator 22.

The print head 200 which is applied to the invention will now be described.

Figure 2:
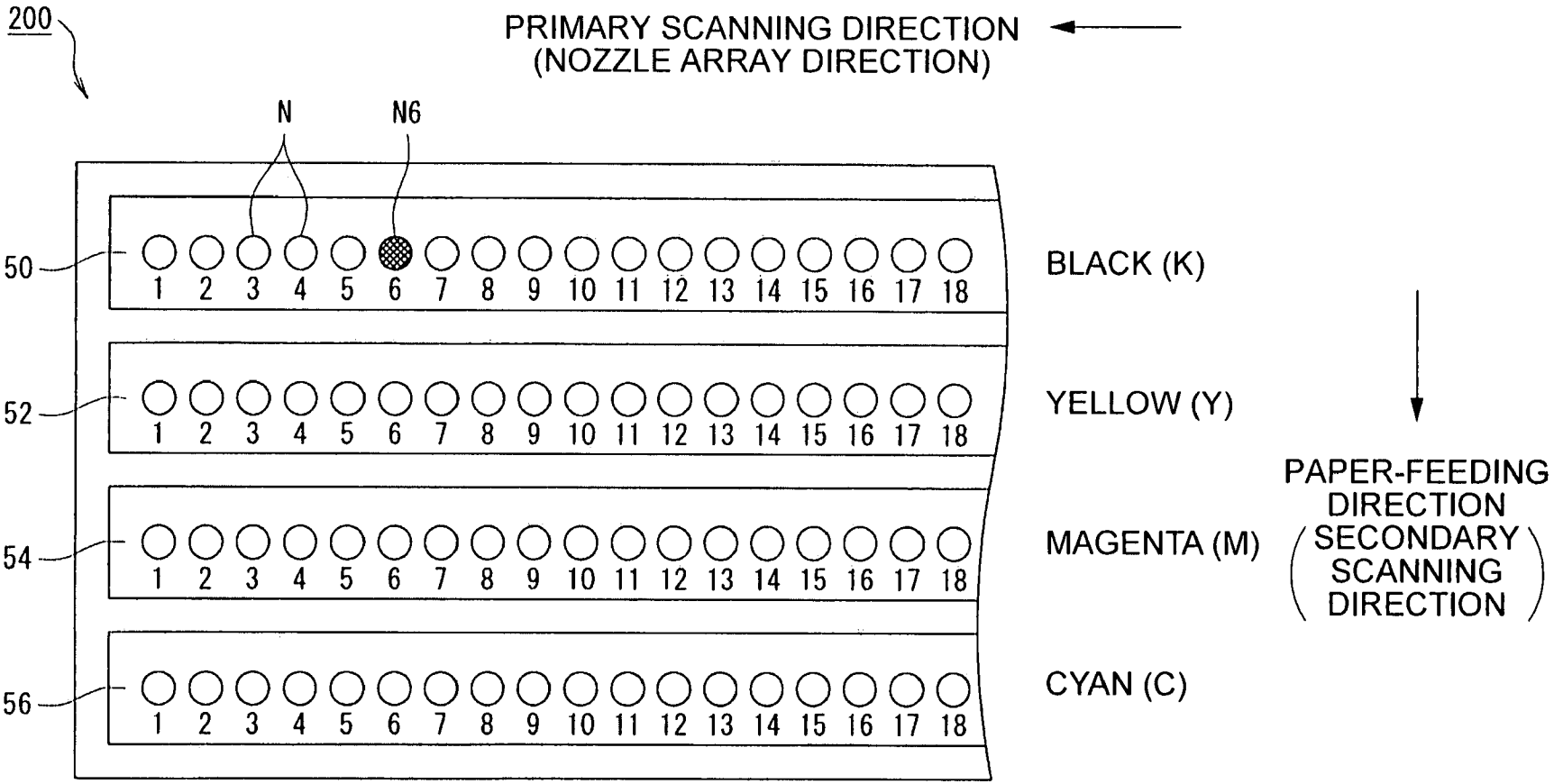
FIG. 2 is a partly enlarged bottom view showing a structure of a print head according to the invention.
Figure 3:
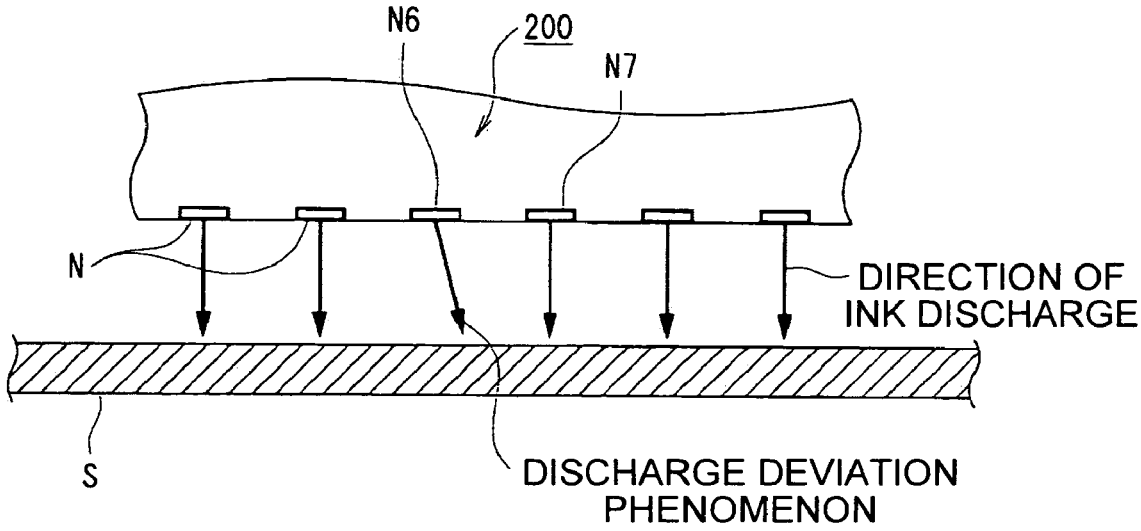
FIG. 3 is a partly enlarged side view showing a structure of the print head according to the invention.

FIG. 2 is a partly enlarged bottom view showing a structure of the print head 200, and FIG. 3 is a partly enlarged side view of FIG. 2.

As shown in FIG. 2, the print head 220 has an enlarged structure extending widthwise of a printer sheet used for so called a line-head type printer, and includes four nozzle modules 50, 52, 54, 56 integrally arranged so as to overlap in a printing direction (secondary scanning direction).

The four nozzle modules are the black nozzle module 50 each having a plurality of (eighteen in the drawing) nozzles N for discharging specifically black (K) ink and being linearly arranged in a primary scanning direction, the yellow nozzle module 52 each having a plurality of the nozzles N for discharging specifically yellow (Y) ink and being linearly arranged in the primary scanning direction, the magenta nozzle module 54 each having a plurality of the nozzles N for discharging specifically magenta (M) ink and being linearly arranged in the primary scanning direction, and a cyan nozzle module 56 each having the plurality of nozzles N for discharging specifically cyan (C) ink and being linearly arranged in the primary scanning direction. In a case of a print head intended for monochrome printing, only the black ink (K) is used, and for a print head targeting high-definition images, six or seven colors of ink including light magenta and light cyan may be used.

The print head 200 in this structure prints circular dots on a white printer sheet by discharging ink supplied into ink chambers, not shown, provided respectively for the respective nozzles N1, N2, N3 . . . from the respective nozzles N1, N2, N3 . . . by piezoelectric elements such as piezo actuators, not shown, provided in the respective ink chambers, and controls the amounts of ink discharge from the ink chambers by controlling voltage to be applied to the piezoelectric element in multi-stage, so that dots of different sizes for the respective nozzles N1, N2, N3 . . . can be printed. There is also a case of forming one dot by combining two times of discharge on the printer sheet by applying voltages to the nozzle in two steps in a short time in time series. In this case, utilizing a property such that a discharging speed is different depending on the dot sizes, a large dot is discharged immediately after a small dot consecutively at substantially the same position on the sheet, so that one dot of still larger size can be formed.

FIG. 3 is a side view showing the black nozzle module 50, which is one of the four nozzle modules 50, 52, 54, 56, showing that the discharge deviation phenomenon occurs in a sixth nozzle N6 from the left, and hence ink from the nozzle N6 is discharged obliquely, whereby a dot is printed (ink-landing) near a normal nozzle N7 located next thereto.

Figure 4:
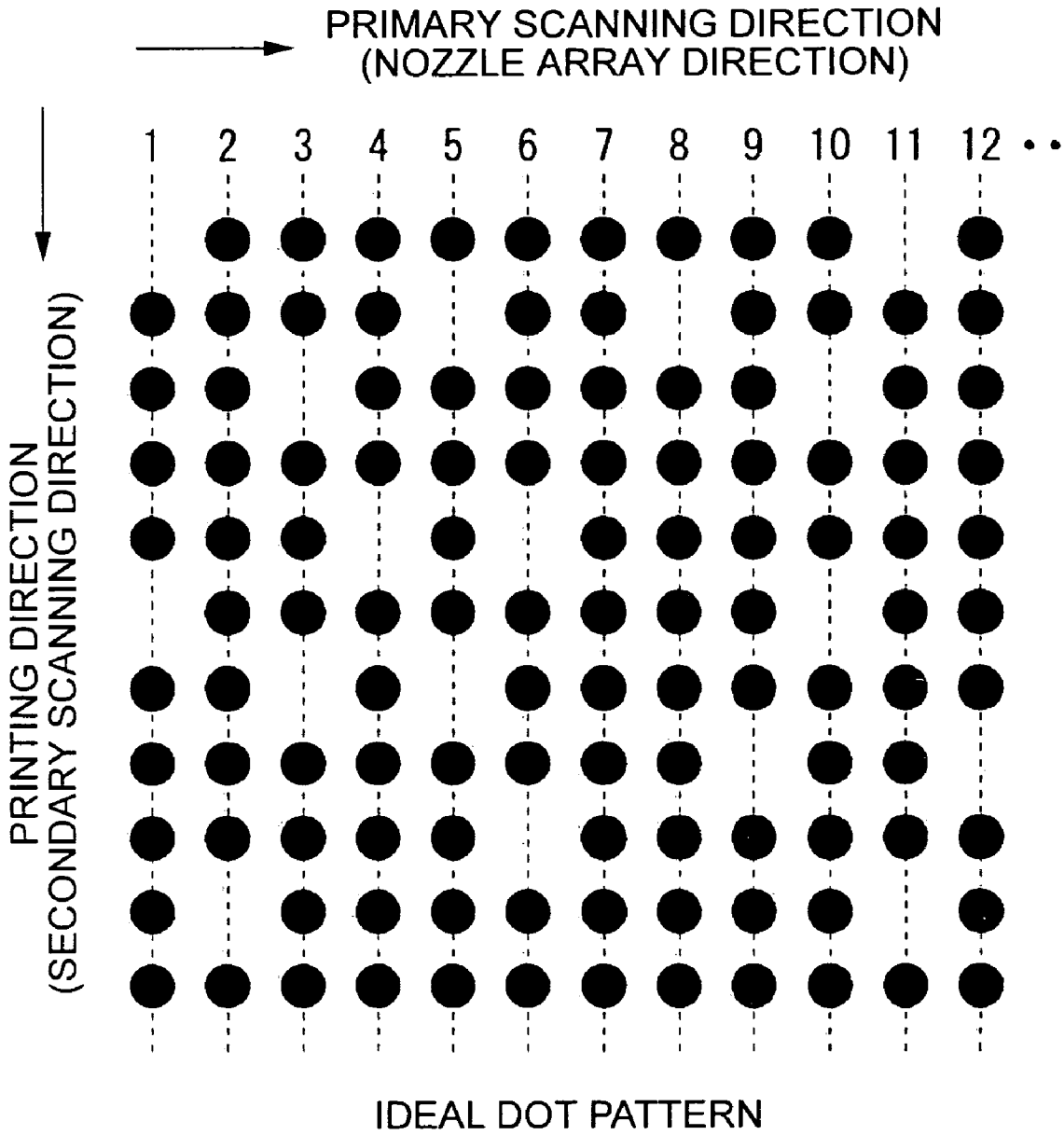
FIG. 4 is a conceptual drawing showing an example of an ideal dot pattern in which discharge deviation phenomenon is not occurred.
Figures 5, 6:
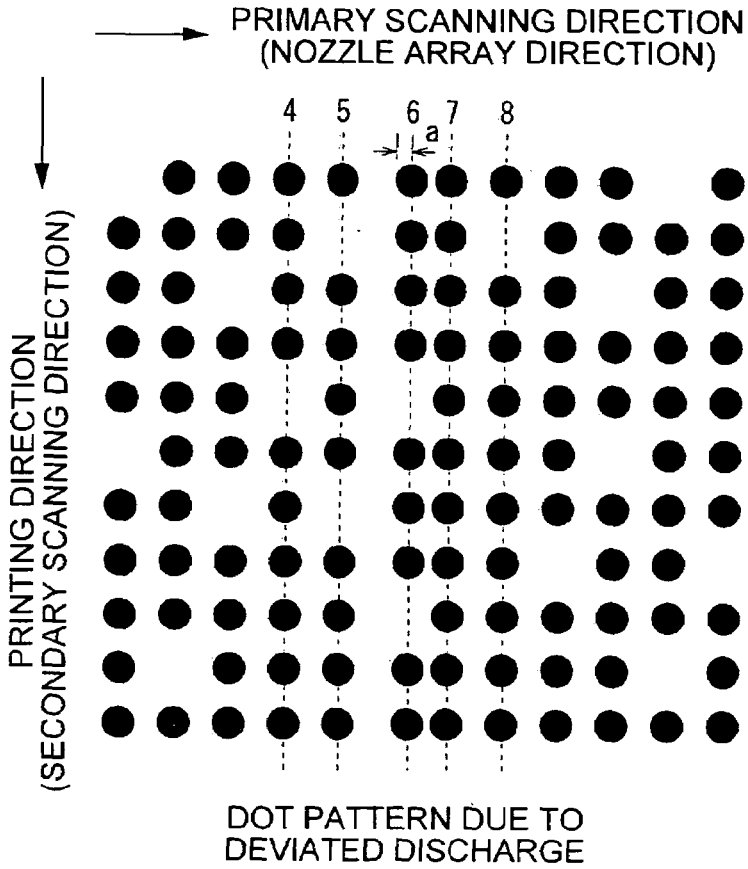
FIG. 5 is a conceptual drawing showing an example of a dot pattern formed as a result of the discharge deviation phenomenon of one nozzle.
FIG. 6 is a drawing showing an example of a dot/gradation table showing a relation of pixel values and gradation values with respect to dot sizes.

Therefore, when printing is performed with the black nozzle module 50, in a state in which the discharge deviation is not occurred as shown in FIG. 4, all the dots are printed on their prescribed positions (ideal dot pattern). However, when the discharge deviation phenomenon occurs, for example, in the sixth nozzle N6 from the left as shown in FIG. 5, the positions of the dots printed thereby are shifted toward the normal nozzle N7 located next thereto by a distance "a" from the intended print positions.

The discharge deviation characteristic information acquirer 10 is adapted to provide a function to acquire information relating specifically to the discharge deviation phenomenon out of the characteristics of the print head 200. More specifically, as shown in FIG. 5 described above, it has a function to acquire and identify detailed information such as whether or not the discharge deviation phenomenon occurs in the print head 200 and, if the discharge deviation phenomenon is occurred, which nozzle N is an abnormal nozzle having the discharge deviation phenomenon, and how much the amount of positional displacement of the dot print position resulted from the discharge deviation phenomenon.

In other words, as shown in FIG. 1, the discharge deviation characteristic information acquirer 10 further includes a print head characteristic storage unit 10*a* or a print head characteristic detection unit 10*b*, so that the characteristics of the print head 200 can easily be acquired when necessary by reading the characteristics of the print head 200 stored in the print head characteristic storage unit 10*a* in advance or reading the characteristics of the print head 200 detected by the print head characteristic detection unit 10*b*.

The print head characteristic storage unit 10*a* is composed of a storage device such as a readable ROM or RAM in which a result of a print head characteristic test conducted when manufacturing the print head 200 or when assembling the printing device 100 (printer 22) is stored, and the print head characteristic detection unit 10*b* is adapted to inspect the characteristics of the print head 200 from the printed result of the print head 200 using an optical printed result reader such as a scanner regularly or at a predetermined timing and to store the result of inspection together with the data in the print head characteristic storage unit 10*a* or by overwriting the same on the data in order to cope with change in the characteristics of the print head 200 after usage. The characteristics of the print head 200 are fixed in the manufacturing stage to some extents, and are considered that they change relatively rarely after manufacture except for a case of failure discharge due to clogging of ink.

The image data acquirer 12 is adapted to provide a function to acquire multi-level color image data to be printed, which are supplied from a print instruction device (not shown) such as a personal computer (PC) or a printer server connected to the printing device 100 via a network, or read and acquire the same directly from a scanner or an image (data) reading device such as a CD-ROM drive, not shown. When the acquired multi-level color image data is multi-level RGB data, for example, image data in which a pixel value (brightness value) for each color (R, G and B) per pixel is represented by 8-bits (0-255) gradations, a function to apply a color conversion processing to the image data and convert the same into multi-level CMYK (in the case of four colors) data corresponding to the respective ink of the print head 200 is carried out in parallel.

The deviated pixel identifier 14 is adapted to provide a function to identify pixels relating to the discharge deviation phenomenon by comparing the amount of discharge deviation and the predetermined threshold out of the respective pixels in the multi-level image data acquired by the image data acquirer 12 based on the discharge deviation characteristic information acquired by the discharge deviation characteristic information acquirer 10.

For example, FIG. 7 shows an example of a discharge deviation information table 300B in which the amount of discharge deviation for the respective nozzles of the print head 200 out of the discharge deviation characteristic information acquired by the discharge deviation characteristic information acquirer 10 is shown. The deviated pixel identifier 14 identifies a pixel that corresponds to the nozzle in which the discharge deviation occurs (hereinafter referred to as "deviated pixel") and pixels corresponding to the nozzles on both sides of the nozzle in which the discharge deviation occurs as pixels relating to the discharge deviation phenomenon based on the discharge deviation information table 300B acquired by the discharge deviation characteristic information acquirer 10.

The amount of displacement detector 16 is adapted to provide a function to detect the amount of positional displacement of the pixels relating to the discharge deviation phenomenon identified by the deviated pixel identifier 14.

The expression the "amount of displacement" means the amount of positional displacement (distance) of the print position of the dot which is actually printed with respect to the ideal (intended) dot print position of each nozzle, and has almost the same meaning as the "amount of discharge deviation". However, since the "amount of discharge deviation" may vary depending on the dot size to be formed even from the same nozzle, both expressions are used for differentiating these conditions in a narrow sense.

Identification of the deviated pixel by the deviated pixel identifier 14 and detection of the amount of positional displacement of the pixels relating to the discharge deviation phenomenon by the amount of displacement detector 16 can also be obtained from a print sample in which a predetermined sample pattern is actually printed by the print head 200.

Figure 9A:
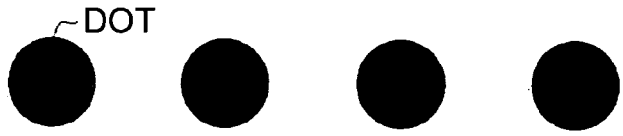
FIGS. 9A and 9B are conceptual drawings showing an image of a dot pattern of a print sample read at a high resolution and variations in density thereof.
Figure 9B:
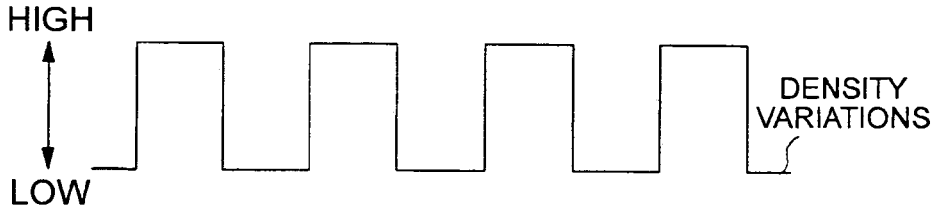

FIG. 9A is a partly enlarged view showing a dot pattern obtained by reading the print sample by an optical reading device such as a scanner, and FIG. 9B shows a density distribution thereof.

When a reading resolution of the optical reading device such as the scanner is sufficient, identification of the deviated pixel and detection of the amounts of displacement of the pixels relating to the discharge deviation phenomenon can be achieved easily based on the data of the read print sample. In other words, in the example shown in FIGS. 9A and 9B, centers of the actual dots can be identified by regarding centers of peaks in the density distribution as the centers of the respective dots, and the centers of troughs in the density distribution can be identified as boundaries (intermediate portions) of the respective dots.

Figure 10A:
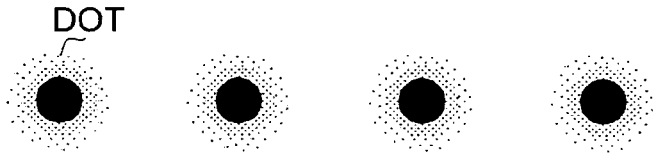
FIGS. 10A and 10B are conceptual drawings showing an image of the dot pattern of the print sample read at a low resolution and variations in density thereof.
Figure 10B:
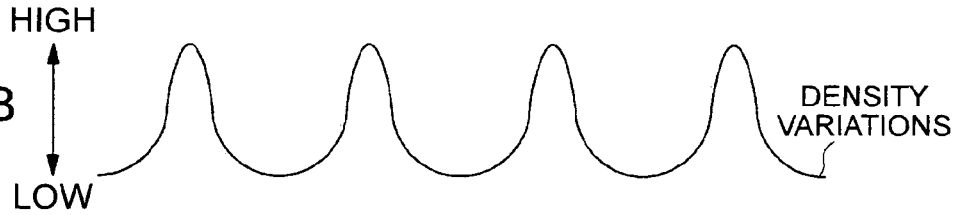

FIG. 10A is also a partly enlarged view showing the dot pattern obtained by reading the print sample by the optical reading device such as the scanner as FIG. 9A, but showing a dot pattern read in a state in which the resolution of the optical reading device that is used for reading the print sample is not sufficient, and FIG. 10B shows a density distribution thereof.

In this manner, in the case of the dot pattern read in the state in which the reading resolution is not sufficient, a contour of the dot is not clear, and hence adequate identification of the center of the dot is difficult. However, by finding the density distribution as described above, the centers of the respective dots and the boundaries between the adjacent dots can be obtained from the variation of the density distribution. In other words, in the example shown in FIGS. 10A and 10B, the actual centers of the dots can be identified by regarding the apexes of the peaks of the density distribution as the centers of the respective dots, and the centers of the troughs in the density distribution can be identified as the boundaries (intermediate portions) of the respective dots. When the reading resolution is not sufficient, even though any one of the apexes of the peaks of the density distribution or the centers of the troughs of the density distribution cannot be identified, if one of those can be identified, the other one can be identified from the information. In other words, if at least the apexes of the peaks in the density distribution can be identified, the centers of the dots can be identified, and hence the centers of the inter-dot distances can be identified as the boundaries between the adjacent dots. On the other hand, if the centers of the troughs in the density distribution can be identified, the boundaries between the adjacent dots can be identified, and hence the centers between the adjacent boundaries between the dots can be identified as the centers of the dots.

The pixel value adjuster 18 is adapted to provide a function to adjust the pixel values of the pixels relating to the discharge deviation phenomenon identified in the deviated pixel identifier 14 based on the amount of positional displacement detected by the amount of displacement detector 16, and detailed example will be described later.

The N-level data generator 12 is adapted to provide a function to generate the N-level data ($M>N\geqq 2$) for the image data in which the pixel value is adjusted by the pixel value adjuster 18.

More specifically, the pixel value (density value) of each pixel in the image data after having adjusted the pixel values of the pixels relating to the discharge deviation phenomenon by the pixel value adjuster 18 is specified as 8-bits, 256 gradations, and when it is converted into a four-level with the gradation: N=4, the pixel value of each pixel is classified into four using three thresholds as shown in a dot/gradation conversion table 300A shown in FIG. 6.

A right column of the dot/gradation conversion table 300A in FIG. 6 shows a relation between thresholds used for converting the multi-level pixel value into the four-level with the gradation: N=4, which is performed by the N-level data generator 20, and the respective pixel values.

In other words, according to the dot/gradation conversion table 300A, when the pixel value (brightness value) of each pixel of the multi-level image data is specified as 8-bits (0-255), three thresholds such as "210 (first threshold)", "126 (second threshold)", and "42 (third threshold)" are used, and the pixel value is converted into four-level with the gradation value=1 (density "0", brightness "255") when the pixel value is "211-255", with the gradation value=2 (density "85", brightness "170") when the pixel value is "127-210", with the gradation value=3 (density "170", brightness "85") when the pixel value is "43-126", and with the gradation value=4 (density "255", brightness "0") when the pixel value is "0-42". When converting into N-level, the gradation of four-level or higher can be expressed artificially by using an area gradation. For example, an error diffusion method is a method of expressing the area gradation. The error diffusion method is a method of realizing the area gradation by diffusing an error generated by converting a hot pixel into the four-level to the pixels which are not converted into the four-level.

The print data generator 22 is adapted to set corresponding dot for each pixel of the N-level data, which is converted into the N-level for each pixel, for generating print data to be used in the inkjet printer 24.

A left column of the dot/gradation conversion table 300A in FIG. 6 is a reference drawing showing a relation between the pixel value of each pixel of the N-level data used in the print data generator 22 and the dot size.

In the example shown in the drawing, when "gradation: N=4", that is, conversion into the four-level is employed, and the "density value" is selected as the pixel value, the dot size when "gradation value=1" is converted into "no dot", the dot size when "gradation value=2" is converted into a "small dot" in which a surface area of the dot is the smallest, the dot size when "gradation value=3" is converted into a "medium dot" which is slightly larger than the small dots, and the dot size when "gradation value=4" is converted into a "large dot" in which the surface area of the dot is the largest, respectively. When the "brightness value" is employed as the pixel value, the pixel value is converted into the dot in the inverse relation from the "density value".

The printer 24 is an inkjet printer configured in such a manner that ink is injected into dots from the nozzle modules 50, 52, 54, 56 formed on the print head 200 while moving one or both of a printer sheet and the print head 200, thereby forming a predetermined image composed of a number of dots on the printer sheet, including, in addition to the print head 200, publicly known components such as a print head feed mechanism, not shown, for causing the print head 200 to reciprocate on a printing medium S in its widthwise direction (in the case of the multi-pass type), a paper feed mechanism, not shown, for moving the printing medium S, and a print controller mechanism, not shown, for controlling ink discharge of the print head 200 based on the print data.

Figure 8:
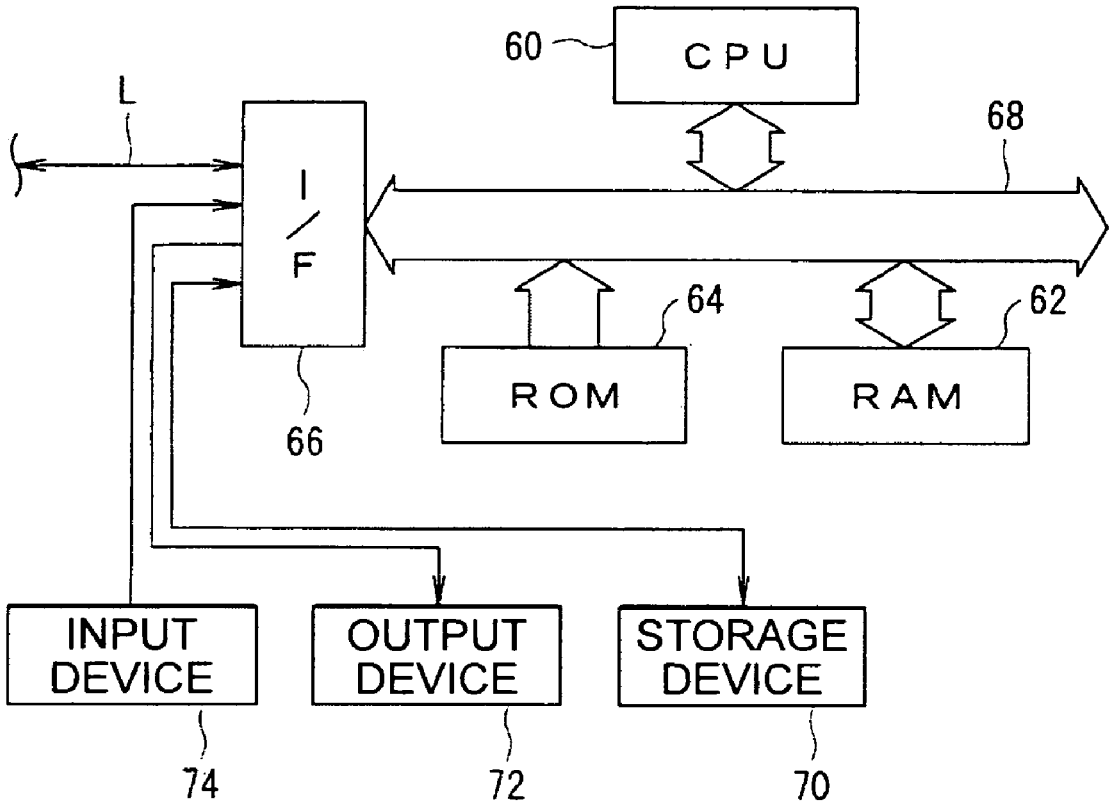
FIG. 8 is a block diagram showing a hardware structure of a computer system that realizes the printing device according to the invention.

The printing device 100 includes a computer system for realizing various control for printing, the discharge deviation characteristic information acquirer 10, the image data acquirer 12, the deviated pixel identifier 14, the amount of displacement detector 16, the pixel value adjuster 18, the N-level data generator 20, the print data generator 22, and the printer 24, etc. on the software. The hardware structure thereof is composed of a CPU (Central Processing Unit) 60 in charge of various controls or computing process, a RAM (Random Access Memory) 62 that constitutes a main storage and a ROM (Read Only Memory) 64 as a storage device specific for reading connected to each other with various internal and external buses 68 such as a PCI (Peripheral Component Interconnect) bus or an ISA (Industrial Standard Architecture) bus, and a secondary storage 70 such as an HDD (Hard Disk Drive), an output device 72 such as the printer, a CRT, an LCD monitor, an input device 74 such as an operating panel, a mouse, a keyboard, and a scanner, and a network L for communicating with the print instruction device, not shown, are connected to the bus 68 via an input/output interface (I/F) 66, as shown in FIG. 8.

When a power is supplied, a system program such as BIOS stored in the ROM 64 or the like loads various specific computer programs stored in the ROM 64 in advance or various specific computer programs installed in the storage device 70 via a recording medium such as a CD-ROM, a DVD-ROM or a flexible disk (FD) or via the communication network L such as internet in the RAM 62, and then the CPU 60 executes a predetermined control and the computing processes using various resources according to command described in the programs loaded in the RAM 62, whereby the various functions of the respective parts as described above can be realized on the software.

Subsequently, an example of a flow of a printing process using the printing device 100 in this configuration will be described referring mainly to flowcharts in FIG. 11.

As described above, the print head 200 for printing dots is adapted to be capable of printing dots in a plurality of colors such as four colors and six colors in general substantially simultaneously. However, the following example will be described assuming that all the dots are printed by the print head 200 for one color (single color) for the clarity of explanation (monochrome image).

Figure 11:
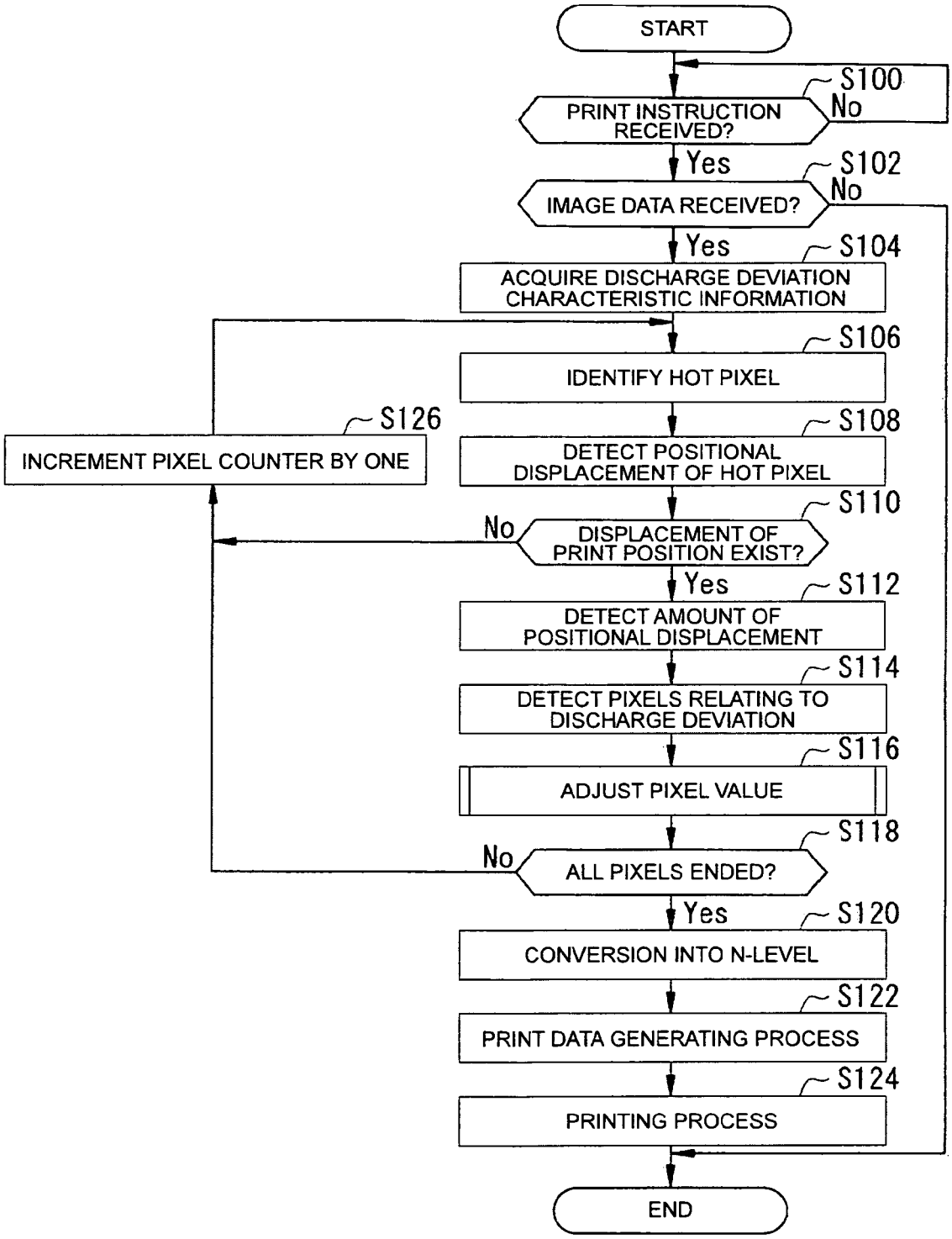
FIG. 11 is a flowchart showing an example of a flow of a printing process according to an embodiment.

As shown in the flowchart in FIG. 11, when a predetermined initial operation for the printing process is completed after the power is turned on, the printing device 100 goes to a first step S100. If a print instruction terminal, not shown, such as a personal computer is connected, the image data acquirer 12 monitors whether or not there is an explicit print instruction from the print instruction terminal. When it is determined that the printing instruction is supplied (Yes), the procedure goes to the next step S102, where whether or not multi-level image data to be printed is supplied from the print instruction terminal together with the print instruction is determined.

Consequently, when it is determined that the image data is not sent, for example, after a predetermined period is elapsed (No), the procedure is ended. When it is determined that the image data is sent within the predetermined period (Yes), the procedure goes to the next step S104, where the discharge deviation information of the print head 200 is obtained by the discharge deviation characteristic information acquirer 10.

When the image data acquired by the image data acquirer 12 is the multi-level RGB data, the image data is converted into the multi-level CMYK data corresponding to the used ink based on a predetermined conversion algorithm as described above.

When the discharge deviation information of the print head 200 is acquired, the procedure goes to the next step S106, where a first hot pixel that is to be processed is identified from the image data, and then the procedure goes to the next step S108.

In S108, the amount of displacement detector 16 detects presence or absence of displacement of print position of the dot corresponding to the hot pixel is detected from the amount of discharge deviation of the nozzle that prints the dot corresponding to the hot pixel out of the nozzles of the print head 200 based on the discharge deviation characteristic information.

When it is determined in next determination step S110 that there is no amount of displacement of print position regarding the dot corresponding to the hot pixel (No) as a result of the amount of displacement detecting process, the procedure goes to S126, where a pixel counter is incremented by "1". Then, the procedure goes back to S106, where a pixel which is next to the first pixel is determined as a hot pixel, and the same procedures are repeated.

Actually, it is normal that the discharge deviation phenomenon occurs to some extent in most of the nozzles of the print head 200. Therefore, most of the dots printed by these nozzles are normally displaced from the ideal print positions to some extent. Therefore, as regards the determination process in the determination step S110, it is preferable to provide a certain threshold (for example, several μm) for the amount of positional displacement, and the presence and absence of the displacement of print position is determined based on the threshold.

On the other hand, when it is determined in the determination step S110 that the displacement of print position occurs regarding the dot corresponding to the hot pixel (Yes), the procedure goes to the next step S112, where the amount of displacement detector 16 detects the amount of positional displacement of the dot corresponding to the hot pixel together with the direction of positional displacement, and the procedure goes to the next step S114.

In S114, the hot pixel and pixels proximate the hot pixel, that is, pixels on both sides of the hot pixel in the nozzle array direction are identified as the pixels relating to the discharge deviation phenomenon, and the pixel values of these pixels are detected. Then, the procedure goes to S116, where the pixel values are adjusted.

FIG. 12A to FIG. 14B show an example of the process from S112 to S116.

FIGS. 12A and 12B show an example of dot patterns corresponding to the respective pixels of the multi-level image data acquired by the image data acquirer 12. A state in which nine dots designated by dot numbers 1 to 9 are printed in a state of being arranged in the nozzle array direction is shown.

In the dot pattern in FIG. 12A, all the dots are printed at the ideal position, while in the dot pattern in FIG. 12B, only the dot No. 6 is displaced in print position, and the print position thereof is displaced from the ideal print position toward the dot No. 7 by a distance "c", therefore the dot array is misaligned.

Vertical lines in the same drawings between the respective dots indicate mid-positions respectively between the adjacent dots, and a distance "a" of these intermediate lines are assumed to be a density area that the respective dots should express (be assigned). In the case of FIG. 12A, the respective intermediate lines are arranged at regular distances. In contrast, in the case of FIG. 12B, the distances of the intermediate lines are misarranged on left and right sides of the dot No. 6 due to the displacement of print position.

In other words, in the case of FIG. 12B, the dot No. 6 is printed at the position displaced from the ideal print position toward the dot No. 7 by the distance "c", and consequently, the intermediate lines on both sides thereof are displaced toward the dot No. 7 by a distance "b", which is half the distance "c", respectively.

Consequently, density areas that the dots No. 5 and No. 6 should express are increased in comparison with the original areas, and the density area that the dot No. 7 should express is decreased in comparison with the original area correspondingly.

Therefore, in a pixel value adjusting process in S116, the pixel values of these three pixels are adjusted based on magnitude of variations in density areas that the respective dots should express as shown in FIGS. 13A and 13B.

The expression "distance between the adjacent dots (pixels)" means basically a physical distance between the dots. However, there are various methods for measuring the distance between the dots as:

1) measuring a distance between centers of gravity of the dots
2) measuring centers of contours of the dots as the centers of dots
3) measuring a distance between the contours of the dots In addition to the three methods shown above, a method of measuring the distance between central values between the methods 1) and 2) as the centers of the dots is also applicable, and any methods may be applied as long as it can measure the physical distance between the dots.

FIG. 13A and FIG. 13B correspond respectively to FIG. 12A and FIG. 12B. Numerals on the respective dots represent the pixel values (8 bits, 256 gradations) of the respective pixels in the image data corresponding to the respective dots.

As shown in FIGS. 13A and 13B, the pixel values of the pixels corresponding to the dot Nos. 1, 2, 3, 4, 8 and 9 are not changed from the original pixel values, but the pixel values of the pixels corresponding to the respective dot Nos. 5, 6, and 7 are adjusted as needed according to the sizes of the density areas that the dots should express (the distance in the nozzle array direction).

In other words, the pixel value of the pixel that corresponds to the dot No. 5 is changed from 142 to 179, that is, increased by "37" from the original pixel value, and the pixel value of the pixel corresponding to the dot No. 6 is changed from 146 to 147, that is, increased by "1" from the original pixel value. In contrast, the pixel value of the pixel corresponding to the dot No. 7 is changed from 150 to 113, that is, reduced by "33" from the original pixel value.

Then, the pixel values shown in FIG. 13B are calculated based on the magnitudes of the density areas that the pixels corresponding to the respective dots No. 5, 6 and 7 should express.

In other words, assuming that the amount of positional displacement "c" of the dot No. 6 shown in FIG. 12B has a relation "c=a/2" with respect to the original distance between the dots "a", "36.5", which is ¼ of the original pixel value "146" of the pixel corresponding to the dot No. 6, is distributed to the pixel corresponding to the dot No. 5 adjacent thereto (whereof the area is widened). In other words, when the print position of the dot No. 6 is displaced by the distance "c" toward the dot No. 7, the intermediate line between the dots No. 5 and No. 6 is moved toward the dot No. 6 by a distance "b(=c/2=a/4)", which is half the amount of positional displacement "c", whereby the density area that the pixel corresponding to the dot No. 5 should express is increased by ¼ of the density area that the pixel corresponding to the dot No. 6 should express. In association thereto, ¼ of the pixel value of the pixel corresponding to the dot No. 6 is distributed to the pixel corresponding to the dot No. 5.

Consequently, the pixel value of the pixel corresponding to the dot No. 5 as shown in FIGS. 13A and 13B is changed from 142 to 179. The pixel value of the pixel corresponding to the dot No. 6 in this state is provisionally "109.5 (146−36.5)".

When the distribution of the part of the pixel value of the pixel corresponding to the dot No. 6 to the pixel corresponding to the dot No. 5 in this manner is completed, the pixel value of the pixel corresponding to the dot No. 7 is distributed to the pixel value of the pixel corresponding to the dot No. 6 by an amount corresponding to the amount of reduction of the density area.

In other words, when the print position of the dot No. 6 is displaced by the distance "c" toward the dot No. 7, the density area that the pixel corresponding to the dot No. 7 should express is reduced by an amount corresponding to the distance "b", and hence the pixel value "37.5", which corresponds to the ¼ of the pixel value "150" of the pixel corresponding to the dot No. 7, is distributed to the pixel which corresponds to the dot No. 6.

Consequently, the pixel value of the pixel corresponding to the dot No. 6 is changed from "109.5" to "147 (109.5+37.5)" and the pixel value of the pixel corresponding to the dot No. 7 is changed from "150" to "113(150×¾)" as shown in FIGS. 13A and 13B.

FIGS. 14A and 14B show a relation of the density areas that the respective pixels should express in terms of surface area after adjustment of the pixel values of the pixels relating to the discharge deviation phenomenon, showing that surface areas of the pixels 5, 6 and 7 out of the pixels shown in the drawing are increased or decreased respectively by a predetermined amount corresponding to the adjustment of the pixel values.

After having completed the adjustment of the pixel values of the pixels relating to the discharge deviation phenomenon in this manner, referring back to the flowchart in FIG. 11, the procedure goes to the next determination step S116, where the same process is repeated until the processing for all the pixels is completed. As a consequence, when it is determined that the processing is completed for all the pixels (Yes), the procedure goes to the next step S120, where conversion into the N-level as shown in the dot/gradation conversion table 300A in FIG. 6 is executed for the respective pixels in the image data in which the pixel values of all the pixels relating to the discharge deviation phenomenon are adjusted by the N-level data generator 20. When executing the conversion into the N-level, a true N-level data can be generated from the original image data by utilizing known technologies for converting the intermediate gradations such as the error diffusion method or a dither method.

Subsequently, the procedure goes to the next step S122, where the print data is generated by the print data generator 22 for the N-level data by allocating dots of the sizes corresponding to the N-level as shown in the dot/gradation conversion table 300A in FIG. 6 for the respective pixels thereof, and then in the last step S124, the printing process is performed based on the print data.

Accordingly, for example, the sizes of all or part of dots in the dot array (in the paper-feeding direction) whose density area is enlarged as the dot No. 5 in FIG. 12B are set to be larger than their original sizes, and the sizes of all or part of dots in the dot array (in the paper-feeding direction) whose density area is contracted as the dot No. 7 in FIG. 12 are set to be smaller than the original size or "no dot".

Consequently, the "white bands" generated between dots at a larger distance due to the displacement of print position are eliminated or become almost invisible, and the "dark bands" generated between dots at a shorter distance are eliminated or become almost invisible. Therefore, the banding phenomenon is reliably alleviated, and a high-quality printed material can be obtained.

The pixel value adjusting process is adapted to adjust the pixel values of the pixels relating to the banding phenomenon on condition that the densities in the density areas in the respective pixels are uniform in the description above. However, the portions on which the dots are printed are high in density, and portions between dots are low in density.

Figure 15A:
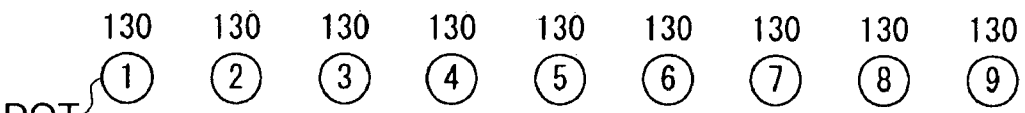
FIGS. 15A and 15B are conceptual drawings showing a density variation pattern according to a visual sensation of a human being with the normal dot pattern.
Figure 15B:
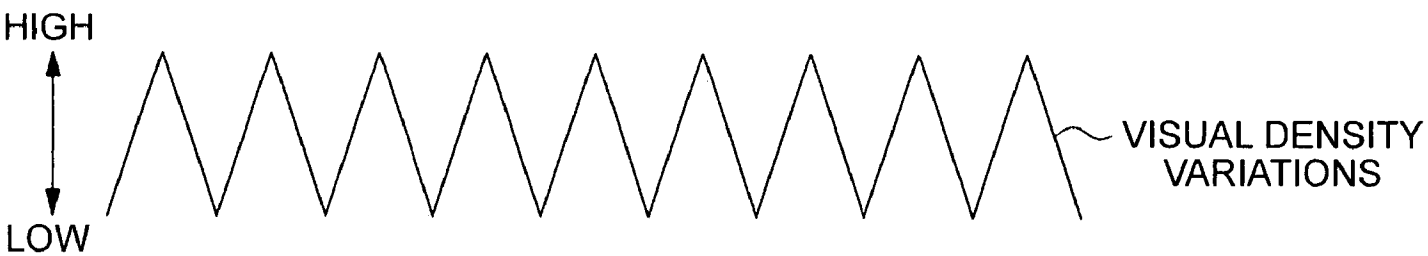

Since a visual frequency characteristic of a human being such that sensitivity decreases with increase in frequency is added, as shown in FIGS. 15A and 15B, the density varies in a zigzag manner such that the density is the highest at the center portions of the respective dots and gradually decreases toward a periphery thereof, so that the density is the lowest at the intermediate portions between dots, and then the density increases again from the intermediate portions between dots toward the adjacent dots, so that the density is the highest at the center portions of the adjacent dots. The pattern of variation in density depends on the color, size, inter-dot distance (resolution), and so on of the dot. For example, in the example shown in FIGS. 15A and 15B, assuming that the pixel values (density values) of the pixels corresponding to the respective dots are "130", the densities at the center portions of the respective dots are "130". The density values at the intermediate portions between dots, where the visual densities are the lowest, are lower by approximately "25", and appear to be about "105".

However, in comparison with the case in which the respective dots are printed at regular intervals, when the print positions of some of the dots are displaced due to the discharge deviation, the intermediate portion between dots adjacent thereto, where the distance is increased, is less affected by the densities of the dots on both sides thereof, and hence the visual density of that portion is significantly lowered in comparison with other intermediate portions.

Figure 16A:
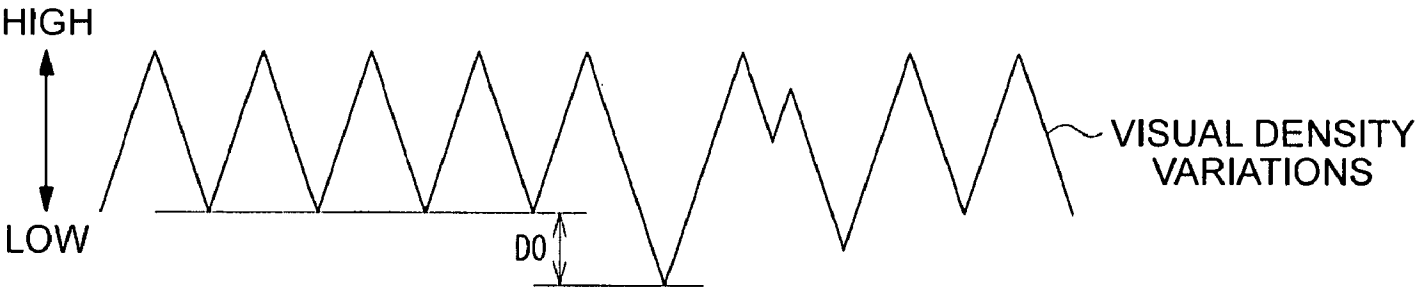
FIGS. 16A and 16B are conceptual drawings showing a density variation pattern according to a visual sensation of a human being, and variation in pixel value with a dot pattern in which displacement of print position is occurred.

FIG. 16A shows a visual variation in density when displacement of print position occurs at the dot No. 6 toward the dot No. 7 due to the discharge deviation phenomenon in the dot pattern shown in FIG. 15A.

As shown in the drawing, a portion between the dot No. 6 which is displaced in print position and the dot No. 5 on the left side thereof is significantly low in visual density, and is further lowered by "D0" in comparison with the visually lowest density values between other dots.

Figure 16B:
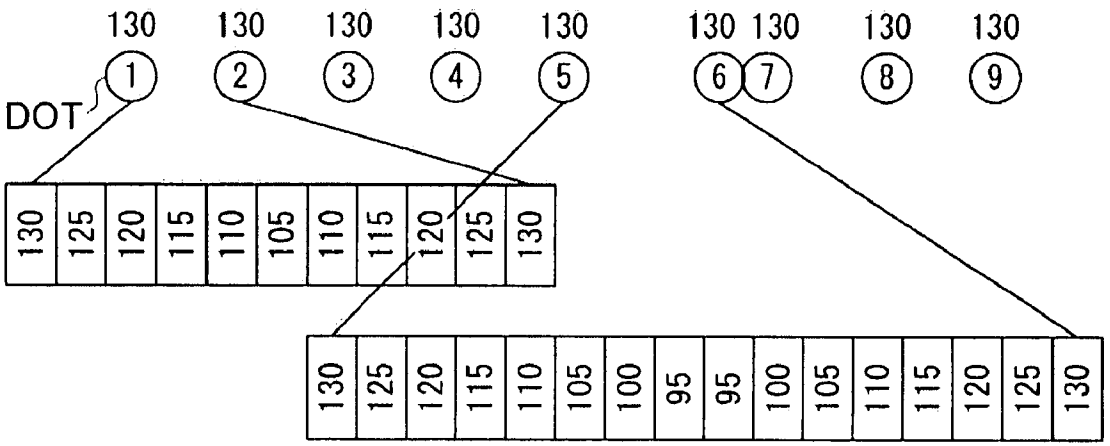

FIG. 16B shows variations in visual density values in areas between the dots by dividing each of the same further into "10" areas. The lowest density value between the normal dots is "105", while the lowest density value between the dot No. 5 and the dot No. 6, whose distance is increased due to the displacement of the print position, is "95", which means that the visual density between them is further lower than the lowest density value between the normal dots by about "10". Due to the difference in lowering of the visual density as described above, the banding phenomenon, specifically the white band, is resulted.

Therefore, by performing the pixel value adjusting process added with the visual characteristics of the human being is executed in addition to the pixel value adjusting process as described above, the banding phenomenon can be eliminated further effectively.

Figure 17A:
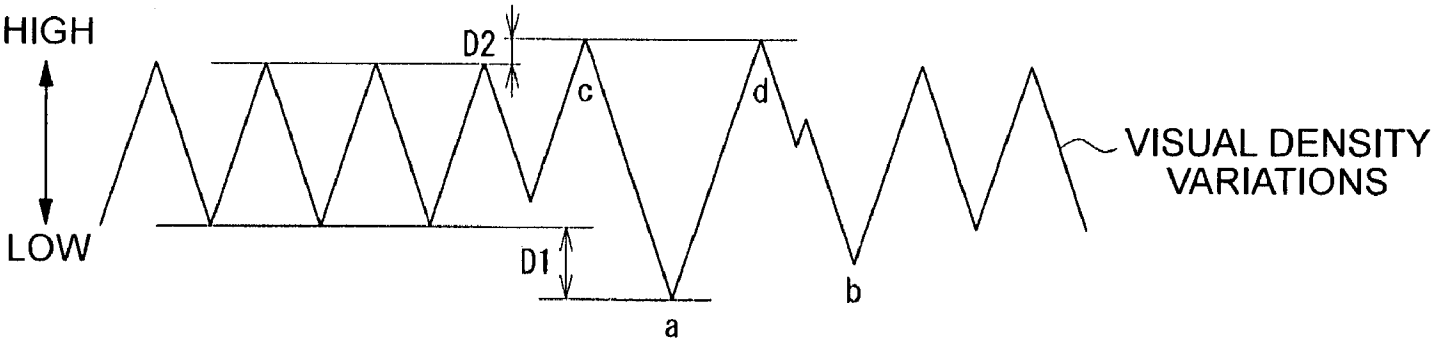
FIGS. 17A and 17B are conceptual drawings showing an example of adjustment of a pixel value with the visual sensation of the human being added thereto and a pattern of variation in density with a dot pattern in which displacement of print position is occurred.
Figure 17B:
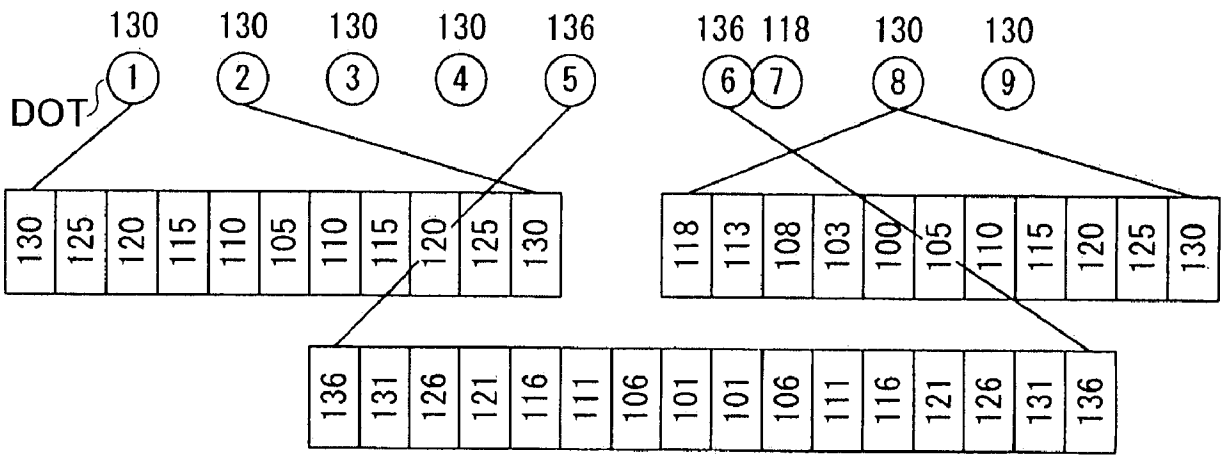

FIGS. 17A and 17B show an example of the pixel value adjusting process added with the visual characteristics of the human being.

Since the extent of lowering in density according to the visual characteristics of the human being is larger at a portion where the inter-dot distance is large in comparison with other inter-dot portions as shown in FIG. 16B, the pixel values corresponding to the two dots (dots No. 5 and No. 6) relating to this portion are increased as shown in FIG. 17B.

Since all the density values of the pixels which correspond to the respective dots are "130" in FIG. 16B, the density values of the pixels which correspond to the dots No. 5 and No. 6 are increased respectively by "6" in FIG. 17B.

Accordingly, the extent of lowering in visual density between the dots No. 5 and No. 6 is restricted, and hence the lowest density value thereof is "101", which is higher in the lowest density value than the case in FIG. 16B by the order of "6".

Consequently, as shown in FIG. 17A, the difference from the lowest density value between the normal dots is reduced such as "D1(<D0)", so that the white band occurred therebetween is eliminated or becomes almost invisible.

When the pixel values of some pixels are increased, the densities of the corresponding portions are locally varied (increased), whereby the area gradation of that portion is changed. Consequently, even though the white band is eliminated, the image quality may be further lowered due to uneven area gradations.

Therefore, at the same time as increasing values which correspond to the dots whose distance is larger, the density values of the dots in the vicinity thereof are reduced correspondingly. Therefore, the variation in area gradation of that portion can be minimized, whereby the lowering of the image quality can be avoided.

In FIG. 17B, the density values of the dots No. 5 and No. 6 are increased respectively by "6", that is, by "12" in total from the original density values, and hence the density value of the dot No. 7, which is the closest to these dots, is lowered by an amount corresponding to the increased amount, that is, from 130 to 118.

Accordingly, the sum of the density values of three pixels which correspond to the dots No. 5, No. 6 and No. 7 is "390(136+136+118)", and an average density value is "130". Therefore, the area gradation of the portion which is applied with the pixel value adjusting process can be brought to the area gradation which is substantially the same as the area gradation of other normal portions.

Consequently, the lowering of the image quality due to the difference in area gradation can be avoided simultaneously.

In the example shown in FIG. 17B, the density values of the dots No. 5 and No. 6 are increased respectively by "6", that is, by "12" in total. This value is calculated in the following manner.

Assuming that the amount of positional displacement "c" of the dot No. 6 is a half the normal inter-dot distance "a" as shown in the example described above, the lowest density value therebetween is the density value obtained by further adding "12.5 (25/2)" to the amount of lowering of the density between the normal dots "25".

Therefore, as shown in FIG. 17A, assuming that the adjustment of the density is executed uniformly by the amount of increase in density value "D2"×2 and the amount of lowering of the density value "D1" as a result of pixel value adjusting process, the adjustment of the amount of lowering of the density value "12.5" may be executed uniformly by "D1" and "D2". Therefore, the amounts of increase in density values of the dots No. 5 and No. 6 become "6.25", which is a half of "12.5". Therefore, the density values of the dots No. 5 and No. 6 are increased by "6", which is obtained by rounding off the value "6.25".

In other words, the amount of difference "diff" in density values between the pixels which correspond to the two dots whose distance is increased is defined as:

$$\text{diff}=(c/a)\times(D/2)$$

where "D" represents the amount of difference in density between dots, "a" represents a pitch between normal dots, and "c" represents the amount of positional displacement.

The amount of difference of the pixel which corresponds to the adjacent dot close thereto may be defined as:

$$2\text{diff}=-2\times\text{diff}$$

In this manner, by executing the adjustment of the pixel value by adding the visual characteristics of the human being such that the extent of lowering in density value is significantly large at a portion where the inter-dot distance is increased, the influence of the displacement of print position can be compensated commonly by increasing density and lowering density.

Although the embodiment shown above has been described on condition that the direction in which the displacement of print position occurs is only the nozzle array direction (primary scanning direction), the same process can be applied also to the discharge deviation phenomenon of the certain nozzles in the paper-feeding direction (secondary scanning direction) by a predetermined amount. In this case, the resolution is enlarged in the paper-feeding direction.

The technology of selecting the proper printed sizes of the dots in one printed material itself is known in the related art, and is a technology which is often used for obtaining a printed material in which a high printing speed and high image quality are achieved in good balance. In other words, the smaller dot size achieves a high definition, while the smaller dot size requires a high performance in machine accuracy. It is necessary to print a number of dots for forming a solid color image with small dots. Therefore, by utilizing a technology of selecting the proper dot sizes such that the smaller dot size is employed for printing the portion of the image in high detail and the larger dot size is employed for the portion of the solid color image, the high printing speed and the high image quality are achieved in a good balance.

A technical method for selecting the proper dot sizes can be realized easily, for example, in the case in which a piezoelectric element (piezo actuator) is used in the print head, by controlling the amount of ink discharge by varying voltage applied to the piezoelectric element.

The dot sizes which can be selected by the print head 200 normally used or according to the aspect of the invention generally include, as shown in FIG. 6, four patterns of "large dot", "medium dot", "small dot", and "no dot". However, the sorts of the dot size are not limited thereto, and there must simply be at least two patterns in addition to "no dot". It is more preferable that the larger number of the patterns is provided.

Some characteristics in the aspect of the invention is that since the pixel values of some pixels of the image data based on the discharge deviation characteristic information are adjusted with little or no modification to the existing print head 200 and the existing printer 24, it is not necessary to provide specific parts additionally as the print head 200 or the printer 24, and the inkjet print head 200 or the printer 24 (printer) existing in the related art can be used without modification.

Therefore, when the print head 200 and the printer 24 are separated from the printing device 100 according to the aspect of the invention, the function can be realized only with a general purpose information processing device (image processing device) such as a personal computer.

The invention can be applied not only to the discharge deviation phenomenon, but also to a case in which the direction of ink discharge is vertical (normal) but the positions where the nozzles are formed are displaced from the normal positions and hence the same dot formation as the discharge deviation phenomenon is resulted in completely the same manner as a matter of course. It is also applied to the banding which occurs in the paper-feeding direction by relative speed fluctuation between the printer sheet and the print head 200. In this case, the image processing can be executed by reflecting information obtained from a sensor disposed therein for detecting the paper feeding speed of the printer sheet on real time basis. It is further applicable to malfunction such that a specific nozzle cannot discharge ink due to clogging or the like. It is also applicable to fluctuation in print timings, and in such a case, the processing may be achieved by feeding back the fluctuation in printed position to the image processing in real time basis.

The printing device 100 according to the aspect of the invention can be applied not only to the line-head type inkjet printer, but also to a multi-pass type inkjet printer. When the line-head type inkjet printer is employed, even when the discharge deviation phenomenon is occurred, the high-quality printed material in which the white bands or the dark bands are almost invisible can be obtained with single-pass operation. On the other hand, when the multi-pass type inkjet printer is employed, the number of reciprocations can be reduced, and hence printing at higher speed than in the related art is achieved. For example, when a desired image quality is achieved by one printing operation, the printing time can be reduced to 1/K in comparison with the case in which the K-times reciprocating printing.

Figure 18A:
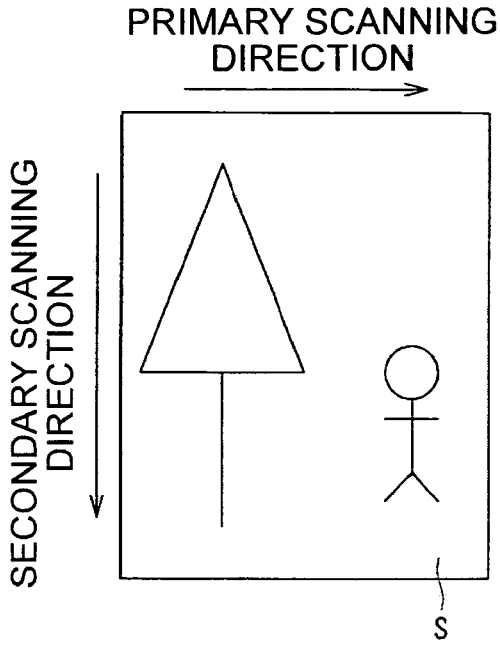
FIGS. 18A to 18C are explanatory drawings showing a difference of a printing method between a multi-pass type inkjet printer and a line-head type inkjet printer.
Figure 18B:
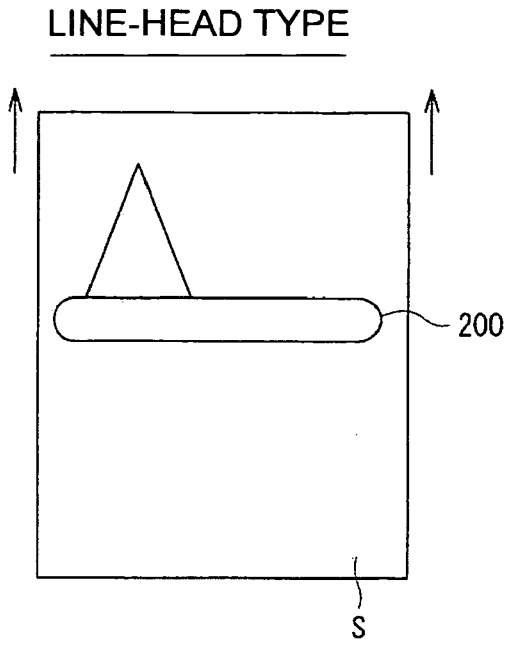
Figure 18C:
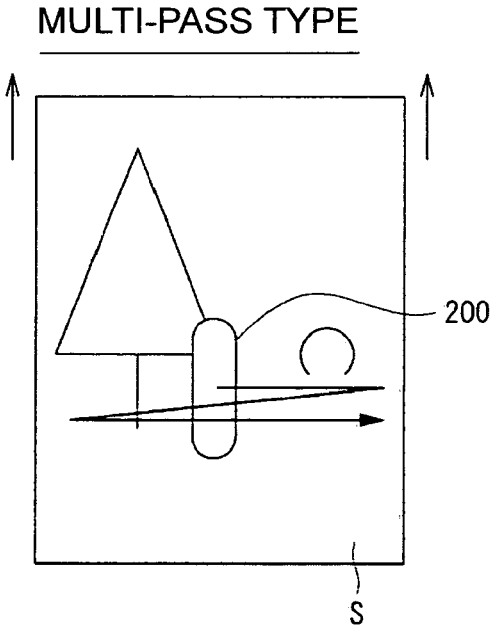

FIGS. 18A, 18B and 18C show printing methods using the line-head type inkjet printer and the multi-pass type inkjet printer respectively.

As shown in FIG. 18A, the direction of the width of the square printer sheet S is assumed to be a primary scanning direction of the image data, and the longitudinal direction thereof is assumed to be a secondary scanning direction of the image data. As shown in FIG. 18B, in the line-head type inkjet printer, the print head 200 has a length corresponding to the width of the printer sheet S, and printing is completed by a so-called single-pass (operation) by fixing the print head 200 and moving the printer sheet S in the secondary scanning direction with respect to the print head 200. It is also possible to perform printing by fixing the printer sheet S and moving the print head 200 in the secondary scanning direction, or while moving both members in the opposite directions as in a case of a so-called flat-bed scanner. In contrast, in the multi-pass type inkjet printer, printing is performed by positioning the print head 200 which is significantly shorter than the length which corresponds to the width of the sheet in the direction orthogonal to the primary scanning direction, and moving the printer sheet S in the secondary scanning direction by a predetermined pitch while reciprocating the same in the primary scanning direction many times as shown in FIG. 18C. Therefore, the latter multi-pass type inkjet printer has a drawback such that it requires longer printing time than the former line-head type inkjet printer, while reduction of the white bands in the banding phenomenon can be achieved to some extent since the print head 200 can be placed repeatedly at desired positions.

Referring now to FIG. 19A to FIG. 20D, several structural examples of line-head type print head and multi-pass type print head will be described. FIGS. 19A to 19D are drawings showing structural examples of print head of the line-head type printer, and FIGS. 20A to 20D are drawings showing structural examples of print head of the multi-pass type printer.

The structural examples of the line-head type print head structures will be described now.

Figure 19A:
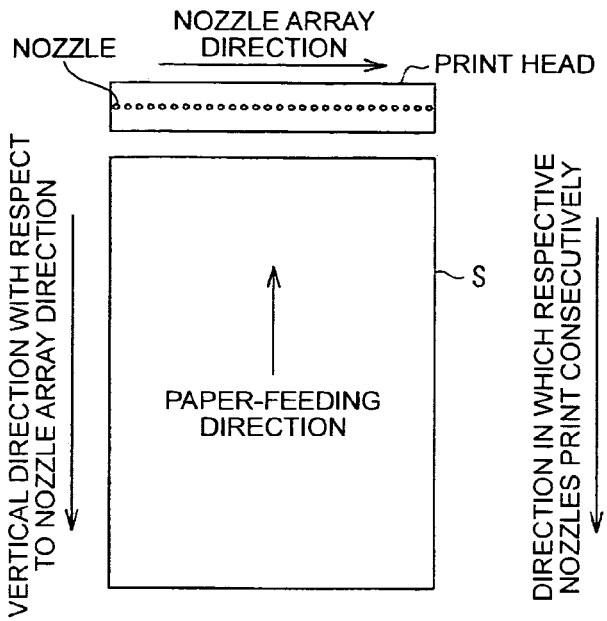
FIGS. 19A to 19D show structural examples of a print head of the line-head type printer.
Figure 19B:
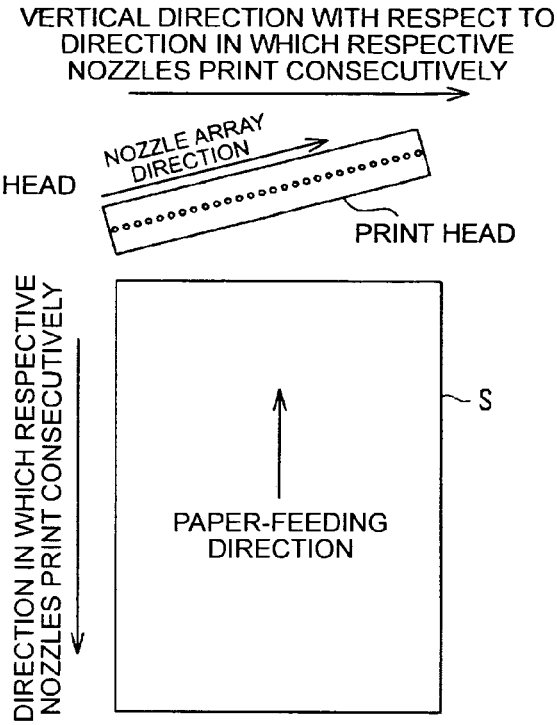

The structural example shown in FIG. 19A is the elongated (the same length as or longer than the width of the rectangular printer sheet S) print head in which a plurality of nozzles are linearly arranged in the same direction as the width of the printer sheet S and the direction of the width is referred to as the "nozzle array direction" and the longitudinal direction of the printer sheet S is referred to as the "direction vertical to the nozzle array direction" which is used in the embodiment shown above. In this structural example, the "direction vertical to the nozzle array direction" corresponds to the "printing direction (paper-feeding direction)". In other words, the "nozzle array direction" is vertical to (or substantially vertical to) the "printing direction". On the other hand, the structural example in FIG. 19B is an elongated print head in which a plurality of nozzles are arranged obliquely with respect to the direction of the width and the "nozzle array direction" and the direction of the width of the printer sheet S are not the same direction. In this structural example, the "direction vertical to the nozzle array direction" and the "printing direction" are not the same direction, and the "direction in which the respective nozzles perform printing consecutively" corresponds to the "printing direction". In other words, the "nozzle array direction" is not vertical to (or substantially vertical to) the "printing direction (paper feed direction)". Therefore, the longitudinal direction of the printer sheet S corresponds to the "direction in which the respective nozzles perform printing consecutively" and the direction of the width of the printer sheet S is not the same as the "nozzle array direction" and is the "direction vertical to the direction in which the respective nozzles perform printing consecutively". In this manner, it is known that an image with high resolution can be obtained by arranging the nozzles obliquely with respect to the direction of the width, which is the direction vertical to the printing direction.

Figure 19C:
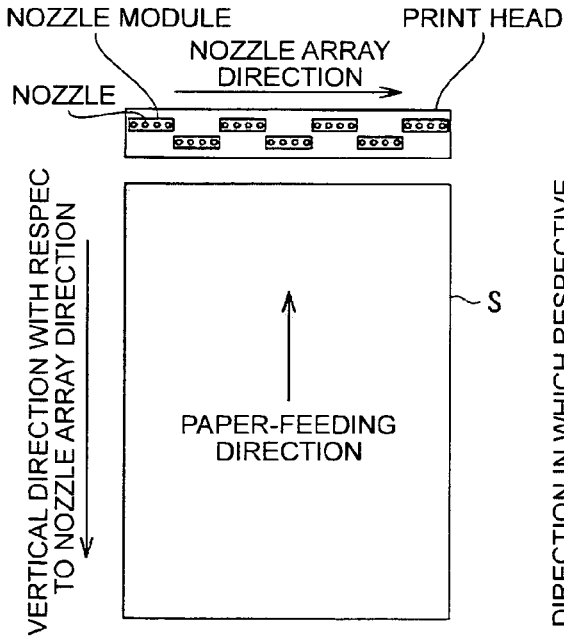
Figure 19D:
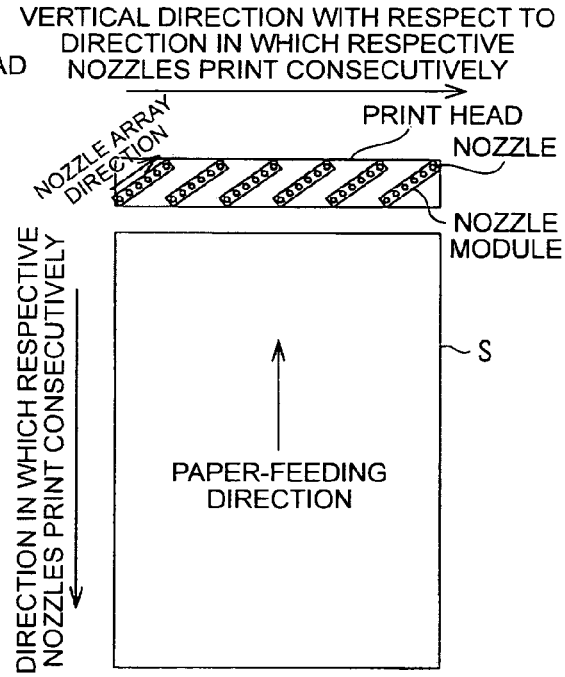

The structural example shown in FIG. 19C is a print head in which a plurality of short nozzle modules each including a plurality of nozzles linearly arranged in the same direction as the direction of the width of the rectangular printer sheet S disposed, not linearly, but alternately in the direction of the width. In this structural example, a single nozzle module is divided into the plurality of nozzle modules, and hence has the same structure as the structural example shown in FIG. 19A, the "nozzle array direction" corresponds to the direction of the width of the printer sheet S, and the "direction vertical to the nozzle array direction" corresponds to the longitudinal direction of the printer sheet S and the "printing direction". On the other hand, the structural example in FIG. 19D is a print head in which a plurality of nozzles are arranged obliquely with respect to the direction of the width of the printer sheet S in the same manner as the structural example in FIG. 19B. However, in the structural example in FIG. 19D, a plurality of short nozzle modules including the plurality of nozzles arranged in the oblique direction are arranged in the direction of the width of the printer sheet S obliquely with respect to the direction of the width thereof. In this structural example, since a single nozzle module is divided into the plurality of nozzle modules, which is the same structure as that shown in FIG. 19B, the longitudinal direction of the printer sheet S corresponds to the "direction in which the respective nozzles perform printing consecutively" and the direction of the width of the printer sheet S corresponds to the "direction vertical to the direction in which the respective nozzles perform printing consecutively".

Subsequently, the structural examples of the multi-pass type print head will be described.

Figure 20A:
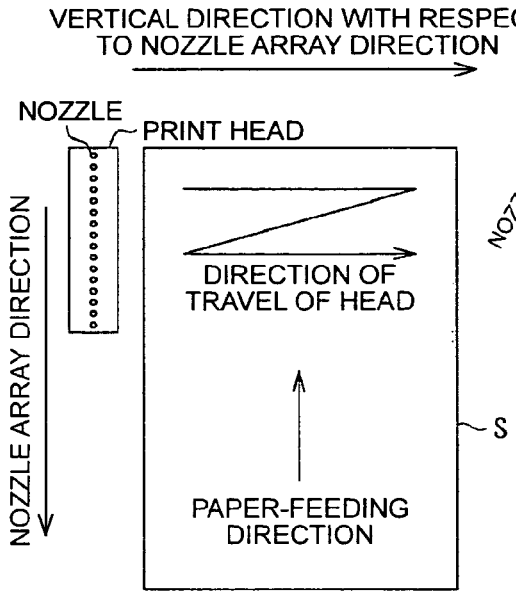
FIGS. 20A to 20D show structural examples of a print head of the multi-pass type printer.
Figure 20B:
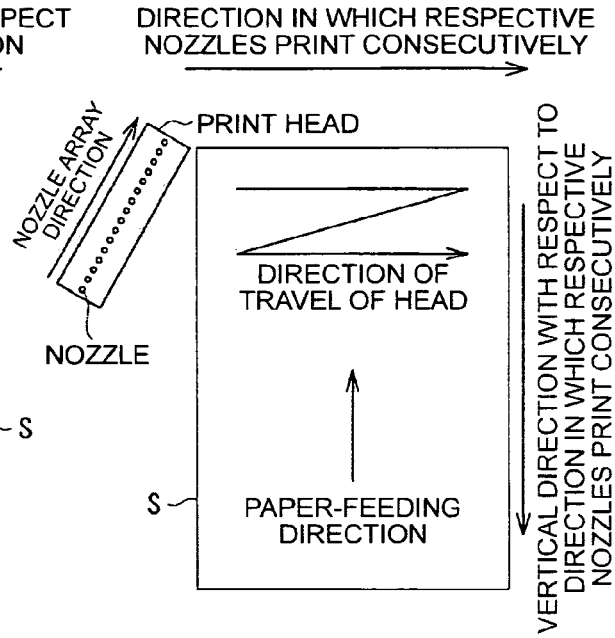

The structural example in FIG. 20A is a short print head including a plurality of nozzles arranged in the same direction as the longitudinal direction of the rectangular printer sheet S, and the longitudinal direction corresponds to the "nozzle array direction", and the direction of the width of the printer sheet S corresponds to the "direction vertical to the nozzle array direction". In the case of this structural example, the "direction vertical to the nozzle array direction" and the "printing direction (paper-feeding direction)" are the same direction. In other words, the "nozzle array direction" is vertical to (or substantially vertical to) the "printing direction". The direction of travel of the print head is such that the print head reciprocates with respect to the direction of the width of the printer sheet S as shown in FIG. 20A. On the other hand, the structural example in FIG. 20B is a short print head configured in such a manner that the "nozzle array direction" and the longitudinal direction of the printer sheet S are not the same direction, and a plurality of nozzles are arranged obliquely with respect to the longitudinal direction. In the case of this structural example, the "direction vertical to the nozzle array direction" and the "printing direction" are not the same direction, and the "direction in which the respective nozzles perform printing consecutively" corresponds to the "printing direction". In other words, the "nozzle array direction" is not vertical to (or substantially vertical to) the "printing direction (paper-feeding direction)". Therefore, the direction of the width of the printer sheet S is not the "nozzle array direction", but the "direction in which the respective nozzles perform printing consecutively", and the longitudinal direction of the printer sheet S is the "direction vertical to the direction in which the respective nozzles perform printing consecutively". It is understood that an image of high resolution can be obtained by arranging the nozzle obliquely with respect to the longitudinal direction, which is the vertical direction of the printing direction.

Figure 20C:
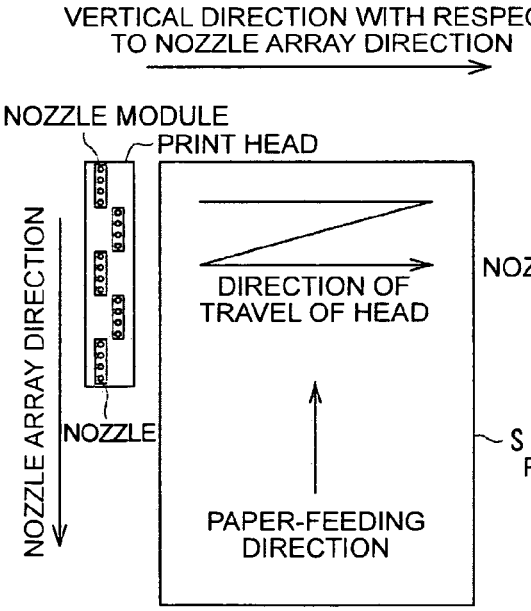
Figure 20D:
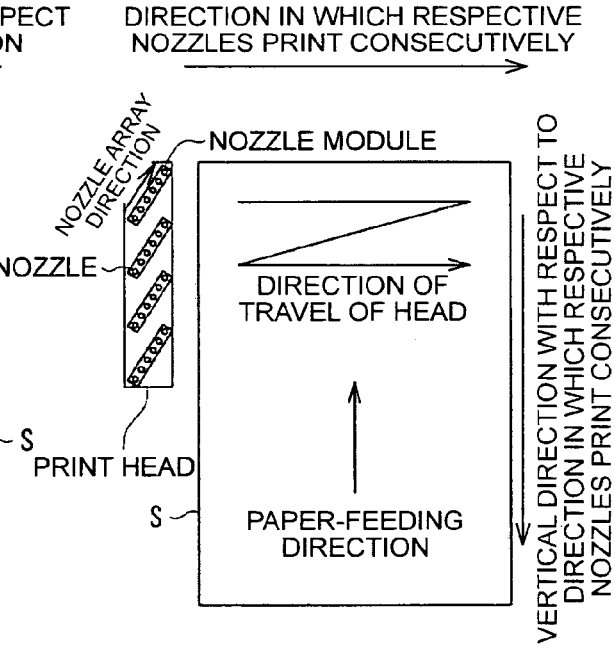

The structural example of FIG. 20C is a short print head of a structure in which a plurality of short nozzle modules each include a plurality of nozzles arranged linearly in the same direction as the longitudinal direction of the rectangular printer sheet S are arranged not linearly, but alternately in the direction of the width. In this structural example, a single nozzle module is divided into a plurality of nozzle modules, and has the same structure as the structural example in FIG. 20A. Therefore, the "nozzle array direction" corresponds to the direction of the width of the printer sheet S, and the "direction vertical to the nozzle array direction" corresponds to the longitudinal direction of the printer sheet S and the "printing direction". On the other hand, the structural example in FIG. 20D is a short print head of a structure in which a plurality of nozzles are arranged obliquely with respect to the longitudinal direction of the printer sheet S as the structural example in FIG. 20B. However, in the structural example in FIG. 20D, a plurality of short nozzle modules including the plurality of nozzles arranged in the oblique direction are arranged obliquely with respect to the longitudinal direction of the printer sheet S. In this structural example, a single nozzle module is divided into a plurality of nozzle modules, and has the same structure as the structural example in FIG. 20B. Therefore, the direction of the width of the printer sheet S corresponds to the "direction in which the respective nozzles perform printing consecutively" and the longitudinal direction of the printer sheet S corresponds to the "direction vertical to the direction in which the respective nozzles perform printing consecutively".

The invention can be applied not only to the print head in which the "nozzle array direction" is orthogonal to the "printing direction" as in the case of the line-head type print head shown in FIGS. 19A and 19C described above, and the multi-pass type print head shown in FIGS. 20A and 20C, but also to a print head in which the "nozzle array direction" is not vertical to the "printing direction" as in the case of the line-head type print head shown in FIGS. 19B and 19D and the multi-pass type print head as those shown in FIGS. 20B and 20D.

Although the example of the inkjet printer that performs printing by discharging ink into dots has been described in this embodiment, the invention can be applied also to other printing devices in which a print head of a mode having printing mechanism arranged in line is employed, such as a thermal head printer, which is referred to as a thermal transfer printer or a thermal printer.

Figure 21:
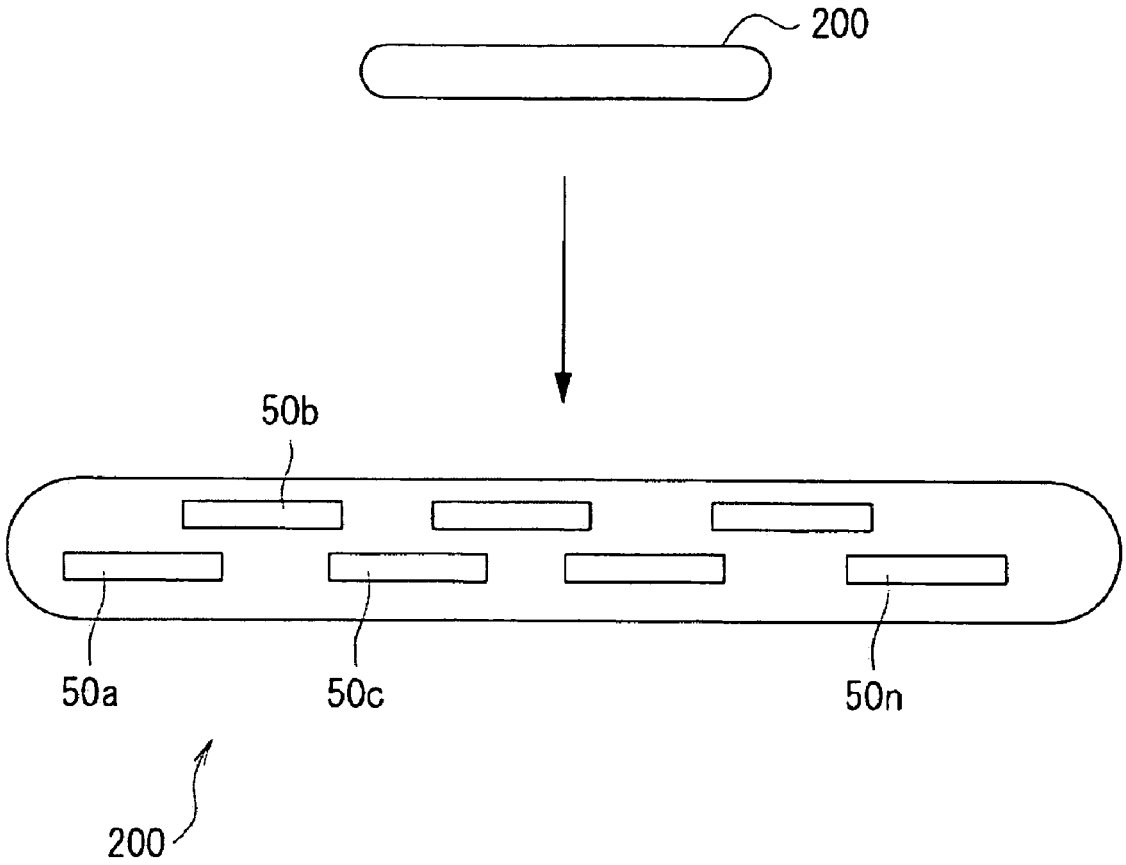
FIG. 21 is a conceptual drawing showing another example of the print head structure.

Although the respective nozzle modules 50, 52, 54, 56 provided for each colors of the print head 200 are in the form having the nozzles N continued linearly in the longitudinal direction of the print head 200 in FIG. 3, a structure in which these nozzle modules 50, 52, 54, 56 are composed of a plurality of short nozzle units 50*a*, 50*b* . . . 50*n* arranged in the front and back in the direction of movement of the print head 200 as shown in FIG. 21 may be employed.

In particular, by providing the plurality of short nozzle units 50*a*, 50*b* . . . 50*n* for the respective nozzle modules 50, 52, 54, 56 as described above, a process yield is improved significantly in comparison with the case of being configured with the long nozzle unit.

The invention has a system to avoid the banding generated due to the nozzle in which the discharge deviation occurs by maneuvering the density information, thereby compensating the amount of the discharge deviation. The cause of the banding also includes fluctuation of the ink amount among the nozzles in addition to the amount of discharge deviation. As a representative method that compensates fluctuation of the ink amount, there is a system to regard the fluctuation of the ink amount as fluctuation in density, and operate the density information. Therefore, since it is the same as the operation information which is intended by the invention, the invention has affinity to the compensation of fluctuation of the ink amount and hence two types of processing can be easily assimilated with each other.

Figure 22:
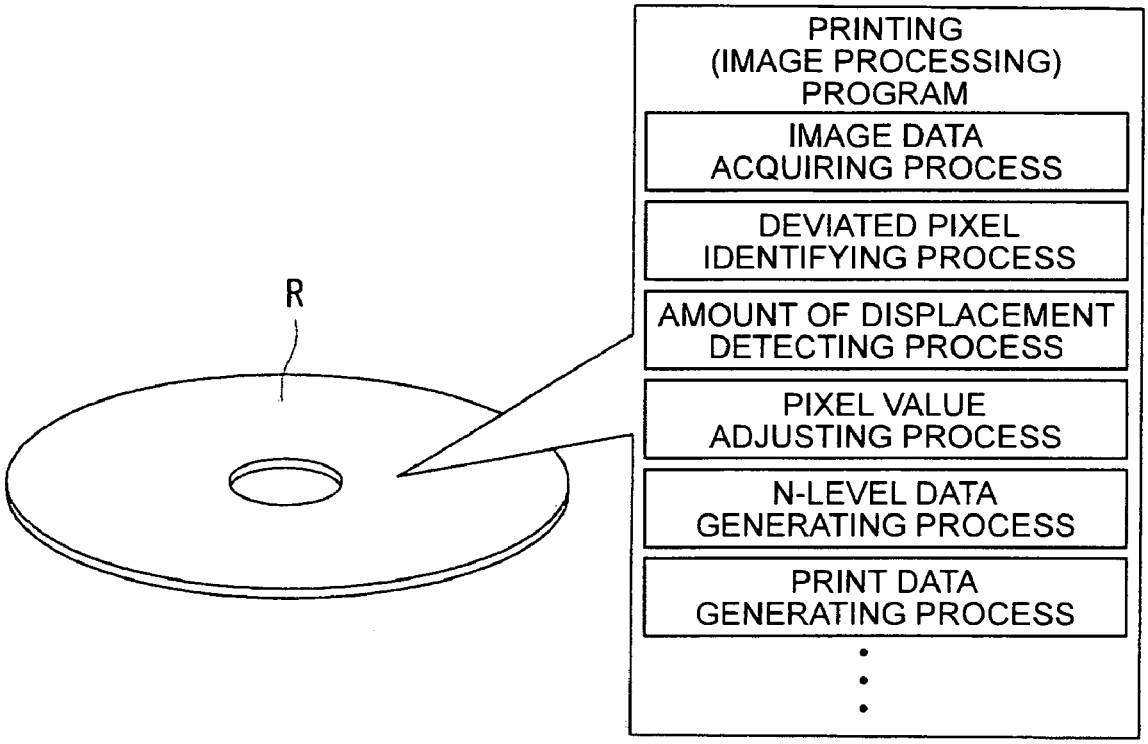
FIG. 22 is a conceptual drawing showing an example of a computer readable recording medium in which a program according to the invention is stored.

The respective parts for realizing the printing device 100 described above can be realized in software using a computer system integrated in most of the existing printing devices, and the computer program can be provided easily to a desired user by integrating in a product in a state of being stored in a semiconductor ROM in advance, distributing via a network such as internet, or via a computer readable recording medium R such as CD-ROM, DVD-ROM, or FD as shown in FIG. 22.

The print head 200 and the discharge deviation characteristic information acquirer 10 in this embodiment correspond to the print head and the discharge deviation characteristic information acquirer in the printing device in Mode 1 respectively, and the image data acquirer 12 corresponds to the image data acquirer in the printing device in Mode 1. The deviated pixel identifier 14, the pixel value adjuster 18, the N-level data generator 20, the print data generator 22, and the printer 24 correspond respectively to the deviated pixel identifier, the pixel value adjuster, the N-level data generator, the print data generator in the printing device in Mode 1.

The amount of displacement detector 16 in this embodiment corresponds to the amount of displacement detector in the printing device in Mode 5.

What is claimed is:

1. A printing device comprising:

a print head having a plurality of nozzles which can print dots in different sizes;

a discharge deviation characteristic information acquirer for acquiring data related to an amount of space between a dot printed by one of the plurality of nozzles and a predetermined target for the dot;

an image data acquirer for acquiring M-level image data ($M \geqq 3$), which includes a plurality of pixel values corresponding to at least three characteristics of the dot, the at least three characteristics including at least one of brightness of the dot and density of the dot;

a deviated pixel identifier for identifying a pixel relating to the dot;

a pixel value adjuster for adjusting the plurality of pixel values for the pixel identified by the deviated pixel identifier;

an N-level data generator for generating N-level data ($M > N \geqq 2$) in which the plurality of pixel values acquired by the image data acquirer is categorized;

a print data generator for generating print data to which the dot has a size corresponding to the respective pixel on the basis of the N-level data; and a printer for executing printing based on the print data generated by the print data generator using the print head.

2. The printing device according to claim 1, wherein the deviated pixel identifier identifies a first pixel corresponding to a first nozzle that creates the dot and a second pixel corresponding to a second nozzle that is adjacent to the first nozzle; and the pixel value adjuster increases a pixel value of the second pixel.

3. The printing device according to claim 1 comprising:

a displacement amount detector for detecting the amount of space between the dot and the predetermined target, wherein the pixel value adjuster calculates an amount of adjustment of the plurality of pixel values based on the amount of space between the dot and the predetermined target, and calculates an inter-dot distance between the dot and an adjacent dot.

4. The printing device according to claim 3, wherein the displacement amount detector detects the amount of space based on a density distribution of a dot pattern printed using the print head.

5. The printing device according to claim 1, wherein the N-level data generator uses at least one of an error diffusion method and a dither method when converting the image data in which the pixel value is adjusted by the pixel value adjuster into N-level image data.

6. The printing device according to claim 1, wherein the print head has a length corresponding to a width of a medium so that printing can be achieved by a single scan without the print head being moved in a widthwise direction of the medium.

7. An image processing device comprising:

a discharge deviation characteristic information acquirer for acquiring data related to an amount of space between a dot printed by one of a plurality of nozzles and a predetermined target for the dot, the plurality of the nozzles being able to print dots in different sizes;

an image data acquirer for acquiring M-level image data ($M \geqq 3$), which includes a plurality of pixel values corresponding to at least three characteristics of the dot, the at least three characteristics including at least one of a brightness of the dot and density of the dot;

a deviated pixel identifier for identifying a pixel relating to the dot;

a pixel value adjuster for adjusting the plurality of pixel values for the pixel identified by the deviated pixel identifier;

an N-level data generator for generating N-level data ($M > N \geqq 2$) in which the plurality of pixel values acquired by the image data acquirer is categorized; and a print data generator for generating print data to which the dot has a size corresponding to the respective pixel on the basis of the N-level data.

* * * * *